US011322851B2

(12) United States Patent
Abramov

(10) Patent No.: US 11,322,851 B2
(45) Date of Patent: May 3, 2022

(54) SHAPE MEMORY DEPLOYABLE RIGID ANTENNA SYSTEM

(71) Applicant: Igor Abramov, Vista, CA (US)

(72) Inventor: Igor Abramov, Vista, CA (US)

( * ) Notice: Subject to any disclaimer, the term of this patent is extended or adjusted under 35 U.S.C. 154(b) by 0 days.

(21) Appl. No.: 16/922,941

(22) Filed: Jul. 7, 2020

(65) Prior Publication Data

US 2022/0013919 A1 Jan. 13, 2022

(51) Int. Cl.
*H01Q 15/16* (2006.01)
*H01Q 19/10* (2006.01)

(52) U.S. Cl.
CPC ..... *H01Q 15/161* (2013.01); *H01Q 19/10* (2013.01)

(58) Field of Classification Search
CPC ..... H01Q 15/161; H01Q 19/10
See application file for complete search history.

(56) References Cited

U.S. PATENT DOCUMENTS

2004/0085615 A1* 5/2004 Hill ..... H01Q 15/161 359/288
2011/0298688 A1* 12/2011 Jalali Mazlouman ... H01Q 9/14 343/895
2017/0201031 A1* 7/2017 Gelb ..... H01Q 13/0283

FOREIGN PATENT DOCUMENTS

KR 101713306 B1 * 10/2015 ..... H01Q 1/087
KR 101868768 B1 * 1/2018 ..... H01Q 1/288

* cited by examiner

*Primary Examiner* — Andrea Lindgren Baltzell
*Assistant Examiner* — Amal Patel

(57) ABSTRACT

Described are several embodiments of parabolic reflective antenna systems where rigid parabolic dishes based on shape memory materials are deployed to full size and shape from compact pre-folded preforms by application of heat. Several shape memory feeds working with the dishes are presented. Feed preforms include corrugated, telescopic and flattened ribbon types which extend or unfurl into final shapes upon application of heat. Several dish and feed embodiments also contain supports for secondary reflectors and patch antennas.

28 Claims, 21 Drawing Sheets

SHAPE MEMORY DEPLOYABLE RIGID ANTENNA SYSTEM

FIELD OF INVENTION

This invention relates to deployable antennae in general and to shape memory deployable dish antenna in particular.

BACKGROUND OF INVENTION

Parabolic dish antennae are desirable for space communications as they offer high so-called antenna 'gain' (concentration and beam width of the signal energy) and through it, extend a satellite's effective communications range. For a given electromagnetic wavelength, the larger the diameter of a dish antenna, the higher its 'gain'.

Rigid permanent dish antennae due to their size and geometry are impractical for smaller satellites, such as 'mini'-, 'micro'- and 'nano'-types of satellites presently gaining wider usage. Present deployable dish antennae have been largely unfeasible as well, due to their size, shape, weight and their deployment mechanism complexity and mechanical interface requirements.

At present, deployable reflector dish antennae used in satellites generally fall into two groups. One group comprises dish antenna assemblies with several petal-shaped rigid elements forming a paraboloid reflector when unfolded. Because these elements are rigid, they are often stowed as a stack, to be opened and deployed rotationally.

The other group includes antenna reflectors which comprise a set of supports to which a flexible reflective membrane is attached. The supporting structures, such as radial ribs, are relatively rigid and are customarily stowed as an elongated bundle folded along its longitudinal axis. Some membrane support structures when deployed take a form of complex three-dimensional lattices which unfurl/unfold in space and support the attached reflective membrane in the required paraboloid shape.

A wide variety of the dish antenna deployment mechanisms exist or have been proposed. They include mechanical gearing assemblies, cables and tensioners and some limited shape memory actuators. Majority of them are mechanically quite complex and sometimes fail to fully deploy the antennae.

The present deployable dish assemblies are also awkward to store since they have to be located and oriented in very limited and specific ways to conform to the available envelopes aboard the launch vehicles while still be a part of a satellite.

Also because of the necessity to conform to the launch vehicle's configuration and the overall satellite physical envelope, the location selection of the antenna on a satellite itself is complicated, subject to numerous constraints and trade-offs.

Additionally, the sometimes off-axis placement of the antenna deployment mechanism adversely affects the center of gravity and rotational moments of a satellite and introduces complications for its in-flight positioning and maneuvering.

The addition of the deployment mechanisms and their rigid mechanical interfaces with the antennae themselves add to the assemblies' bulk, weight and complexity, the latter leading to their reduced overall reliability.

OBJECTIVES OF THE INVENTION

Thus, it is the objective of instant invention to provide a compact deployable dish antenna assembly which prior to deployment would be stowable in a variety of locations and at various attitudes on a satellite.

Another objective is to provide an antenna whose deployment would be reliable.

Another objective is to provide an antenna with high volumetric packing efficiency.

Yet another objective is to provide an antenna which would not require separate mechanical deployment mechanism.

Another objective is to provide an antenna which would be lightweight.

Yet another objective is to provide an antenna which would be compatible with deep space environment.

Another objective is to provide an antenna whose deployment would be energy efficient.

SUMMARY OF THE INVENTION

In accordance with the present invention, shape memory based deployable reflective dish antenna is described and its several embodiments are presented.

The shape memory antenna dish is formed into its desired deployed shape during manufacturing and subsequent 'training' where it is mechanically restrained in the deployed geometry while being heated at—or above the phase—or glass transition temperature of the shape memory material and is allowed to cool off. Thereafter, mechanical restraints are removed at which point the dish remains in its deployed configuration. The dish then is highly radially folded/corrugated to provide for efficient storage.

The shape memory dish antenna remains in its packaged configuration until deployment. At deployment it is heated to—or above the phase—or glass transition temperature of the shape memory material, and returns to their original 'as-trained' shape.

In addition to the dish itself, several shape memory antenna feeds are also presented, some with telescopic waveguide elements extended by several types of shape memory actuators and some having an extendable shape memory waveguides formed from corrugated tubular shape memory preforms. These feeds can be used interchangeably with the antenna dish.

Some antenna embodiments presented, in addition, include deployable sub-reflectors positioned above the main reflector and facing the feeds, and some use small patch antennas instead of the feeds and sub-reflectors.

Articles made with shape memory materials, their fabrication, 'training' and usage are known in their respective arts.

PRIOR ART

The prior art for deployable antennae is extensive, since these antennae have been a key piece of communications equipment for satellites from the dawn of space exploration. Deployable antennae with shape memory elements are relatively new, however.

For example, U.S. Pat. No. 7,710,348 to Taylor et al. teaches a deployable antenna reflector which utilizes a shape memory element to open conventional rigid ribs supporting a flexible reflector.

U.S. Pat. Nos. 8,259,033 and 9,281,569, both to Taylor et al. teach a deployable antenna reflector with longitudinal and circumferential shape memory stiffeners supporting a reflective elastic material.

U.S. Pat. No. 10,170,843 to Thomson et al. teaches mechanically actuated foldable support conventional ribs for antenna reflector and a pleated foldable reflector itself.

None of the prior art above suggests or teaches a deployable shape memory solid reflector created from a folded/corrugated preform.

None teaches deployable shape memory antenna feeds or sub-reflector supports, or using patch antennas in conjunction with parabolic reflectors.

OBJECTS AND ADVANTAGES

In contrast to the prior art mentioned hereinabove, the instant invention describes shape memory dish antenna which offers the following advantages.

High Volumetric Storage Efficiency

The reflector of the instant antenna system is tightly folded and merely requires application of heat for its deployment. Without any mechanical deployment apparatus, the resulting assembly offers a very dense package. The required heaters can be very compact as well, or the reflector can be heated directly with electric current.

In addition, the very shapes of the deployable reflector can be optimized for both storage and for deployment. Thus, greater design latitudes exist to optimize packaging, interface with the satellite, and deployment of the antenna.

Light Weight

Due to the absence of the relatively heavy mechanical deployment drives and their associated interfaces, the weight of instant antenna system is greatly reduced. The required heaters can be very thin and lightweight and in some applications the actuating heat can be generated by passing electric current directly through the reflector and feeds themselves. A completely passive heating and subsequent antenna deployment can be achieved by exposing the antenna system elements to sunlight by appropriately maneuvering the satellite. In the vacuum of space, solar heating can be considerable.

Simplified Construction

The instant antenna system comprises a very limited number of parts. There are basically no separate 'actuators' per se, other than heaters, with the system elements deploying themselves upon application of heat, by utilizing elastic energy stored at the time of packaging. The deployment heaters of instant invention are much smaller and less complicated than mechanical actuators of the present deployable antennas.

Improved Reliability

With thermal actuation of instant invention replacing present electro-mechanical actuators the instant antenna system is much more reliable, since the only moving parts are the very support elements themselves. With timed heater activation specific deployment sequences are possible to minimize the risk of malfunction or interference.

Easier Redundancy Implementation

Since it is much easier to provide redundancy to an electrically heated deployment system than to a mechanical actuator(s)-based one, the shape memory based antenna systems can have enhanced redundancy of its deployment apparatus.

Heating and Deployment by Sunlight

As mentioned above, since heating of satellite components by solar radiation in space can be considerable, the instant antenna system elements can be exposed to sunlight instead of heaters for deployment. This also can be used as a backup procedure in case of a heater failure. To facilitate sunlight heating the system elements can have radiation-absorptive coating(s).

High Stored Energy

The shape memory materials used for the support elements store considerable elastic energy at the time of packaging and can generate considerable forces during deployment to overcome potential adhesions, friction and snags.

Relaxed Requirements for Placement/Orientation on Satellite or Launch Vehicle.

Due to the compact size of the antenna system its location on a satellite is not as constrained as for the present deployable antennas. This simplifies the design of a satellite itself and/or its operations. In addition, the instant antenna system can be more easily located to minimize its effect on the location of the satellite's center of gravity, which will also simplify satellite operations.

DESCRIPTION OF THE EMBODIMENTS

In the foregoing description like components are labeled by the like numerals.

Figure 1:
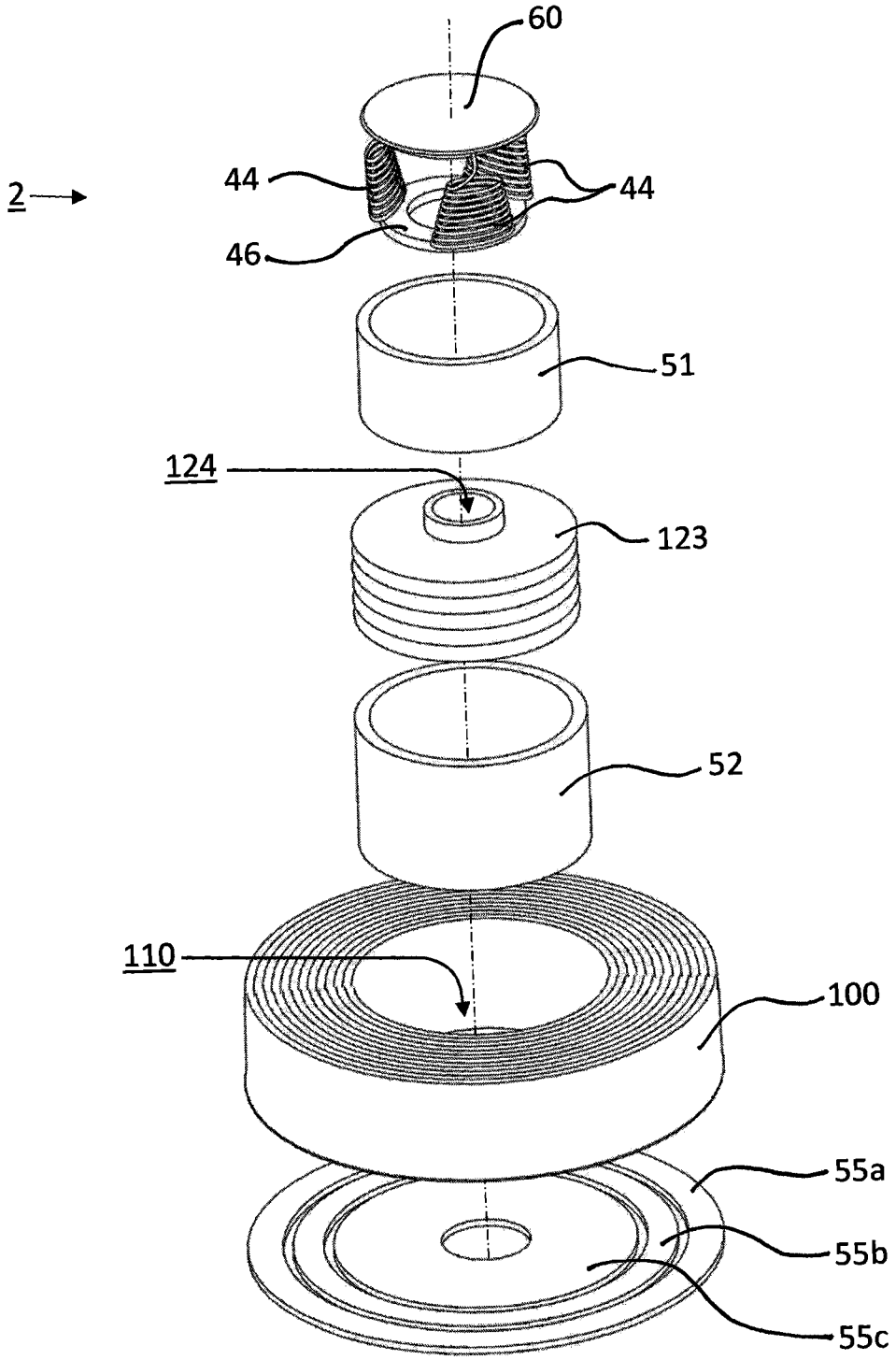
FIG. 1 is an exploded perspective view of the antenna assembly embodiment 2 in stowed configuration.

Deployable antenna system 2 is depicted in an exploded view on FIG. 1. Primary reflector 100 of system 2 made with shape memory material is folded into a radially pleated cylindrical shape with central volume 110 allotted for feeds, their heaters and/or any mounting fasteners that may be required for mounting the system.

A preferably convex secondary reflector 60 is connected to coiled extendable supports 44 made with shape memory material mounted on ring 46 which in turn is connected to the upper face of feed 123. Supports 44 are heated for deployment by a tubular upper heater 51.

Corrugated feed 123 made with shape memory material with lumen 124 is coaxially positioned at the center of reflector 100 and is surrounded by a tubular lower heater 52 which heats feed 123 for its extension and deployment.

Bottom heaters 55*a*, 55*b* and 55*c* controllably heat dish 100 for its transition into deployed configuration 100*a*.

Figure 2:
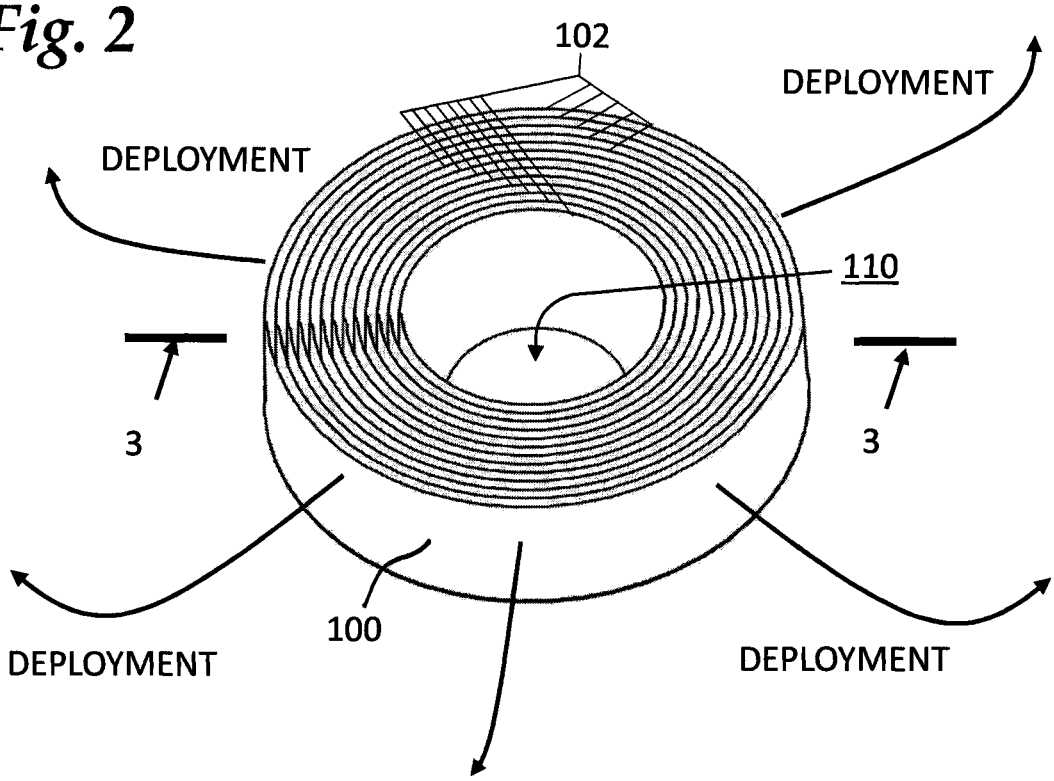
FIG. 2 is a perspective view of the antenna dish 100 in stowed configuration.
Figure 3:
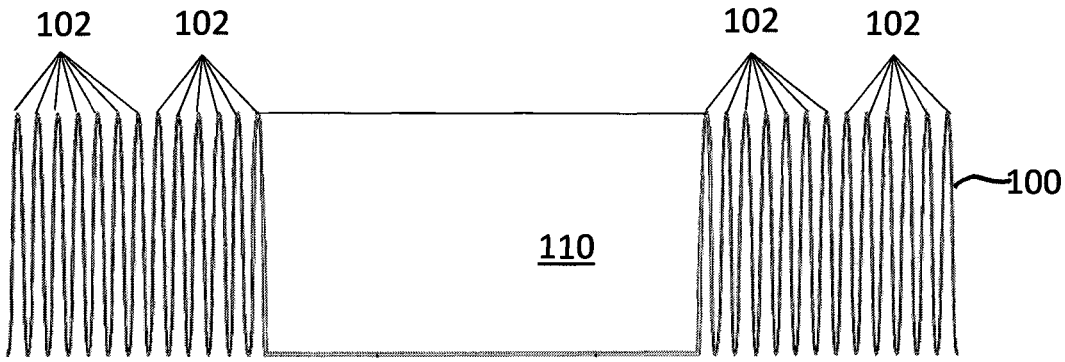
FIG. 3 is a cross section view of the dish 100 in stowed configuration taken along line 3-3 on FIG. 2.
Figure 4:
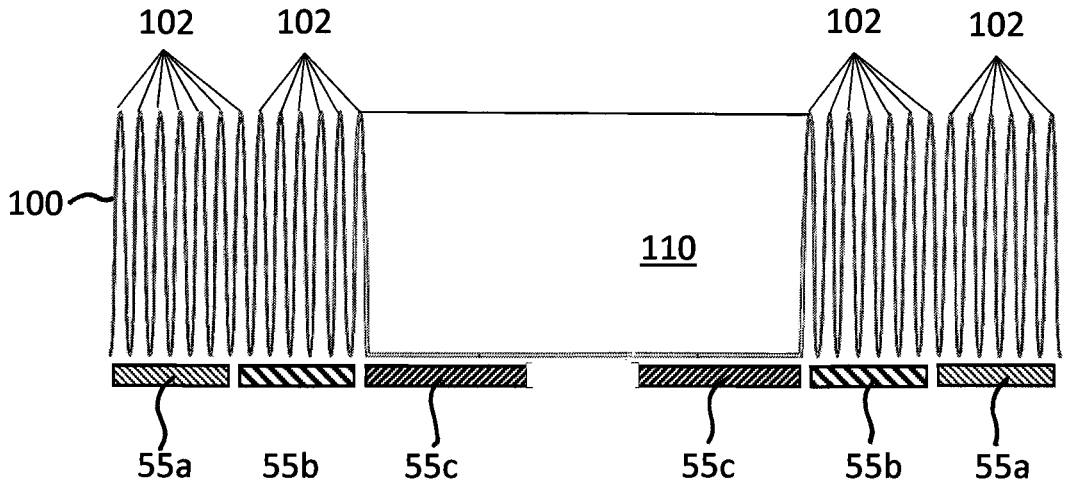
FIG. 4 is a cross section of the antenna system based on dish 100 with its heaters.

FIGS. 2 and 3 show a close-up of dish 100 in its stowed configuration and its cross section taken along line 3-3, respectively. Pleated sections 102 of dish 100 extend radially and perpendicularly to the dish center line upon being heated.

Figure 6:
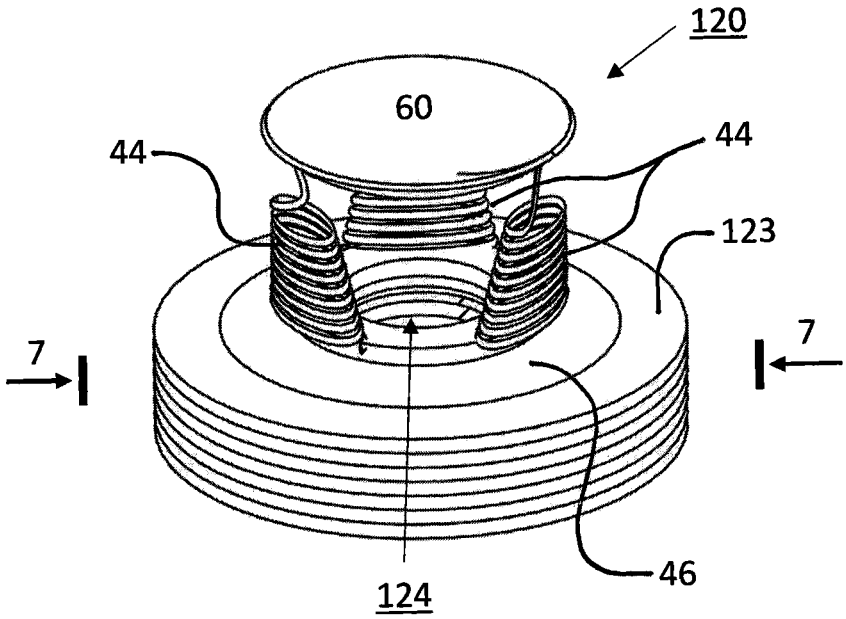
FIG. 6 is a perspective view of the feed assembly 120 in stowed configuration.

FIG. 6 depicts feed assembly 120 in stowed configuration. The assembly 120 comprises secondary reflector 60 supported by coiled extendable supports 44 which rest on support ring 46. The extendable feed 123 is in its stowed configuration.

Figure 7:
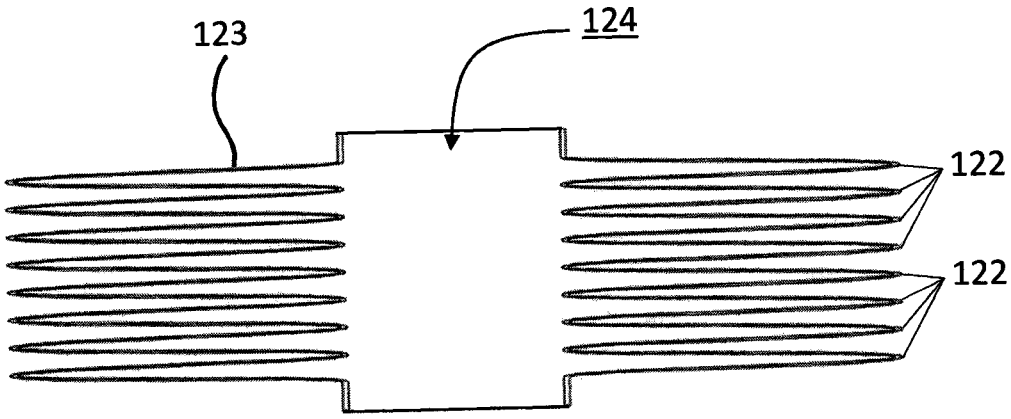
FIG. 7 is a cross section view of the feed 123 in stowed configuration.

FIG. 7 shows a cross section of feed 123 further detailing corrugations 122 oriented perpendicular to its longitudinal axis.

Figure 8:
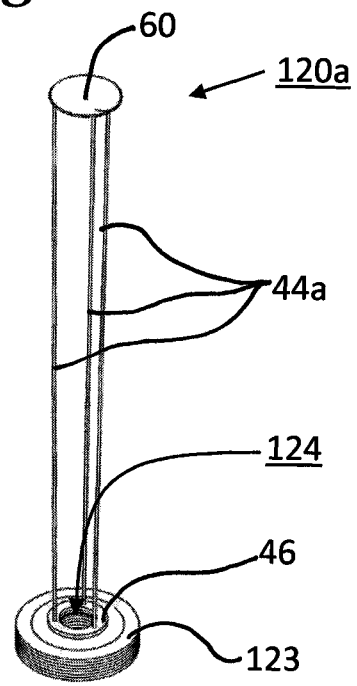
FIG. 8 is a perspective view of the feed assembly 120 in a partially deployed configuration 120*a*.

FIG. 8 shows feed assembly 120 in its partially deployed configuration 120*a*. Upon action of heater 51 (not shown) coiled supports 44 straighten into their deployed configurations 44*a* and deploy secondary reflector 60.

Figure 9:
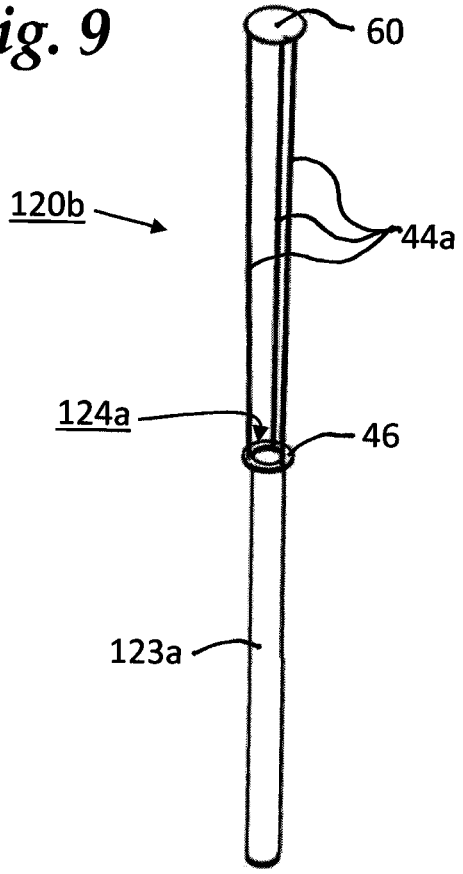
FIG. 9 is a perspective view of the feed assembly 120 in a fully deployed configuration 120*b*.

FIG. 9 shows feed assembly 120 in its fully deployed configuration 120*b*. Upon action of heater 52 (not shown) waveguide 123 extends into its deployed configuration 123*a* with a fully defined tubular lumen 124*a*.

Figure 10:
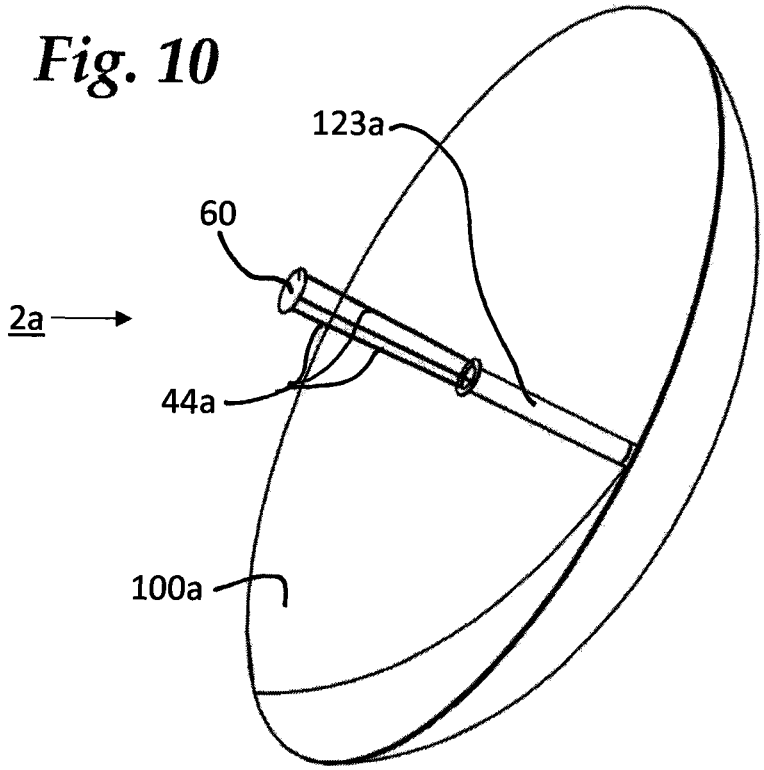
FIG. 10 is a perspective view of the antenna embodiment 2 in fully deployed configuration 2*a*.

Referring to FIG. 10, after activation of all shape memory components by all the heaters is complete, antenna assembly 2 is in fully deployed configuration 2*a* with dish 100 fully deployed in 100*a* configuration, feed 123 fully extended to its 123*a* configuration and secondary reflector 60 fully deployed by extended supports 44*a* to face dish 100*a*.

Figure 11:
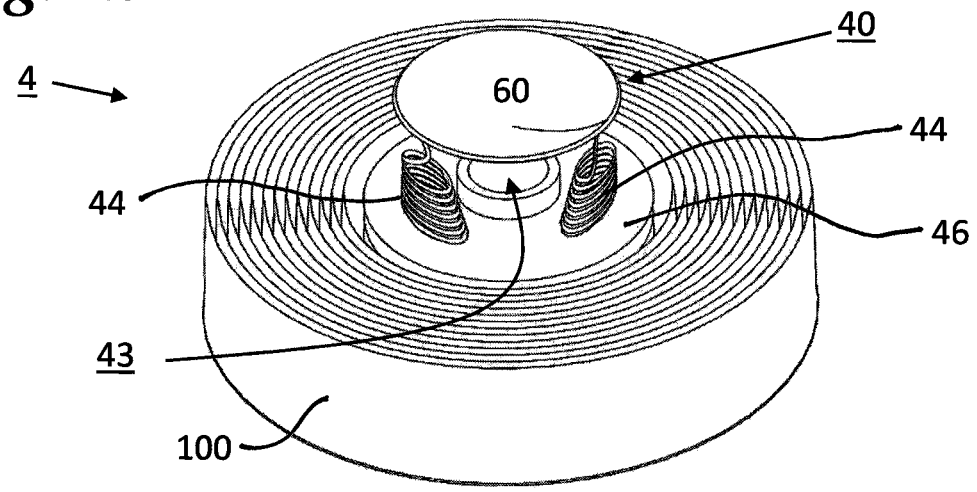
FIG. 11 is a perspective view of the antenna embodiment 4 in stowed configuration.
Figure 12:
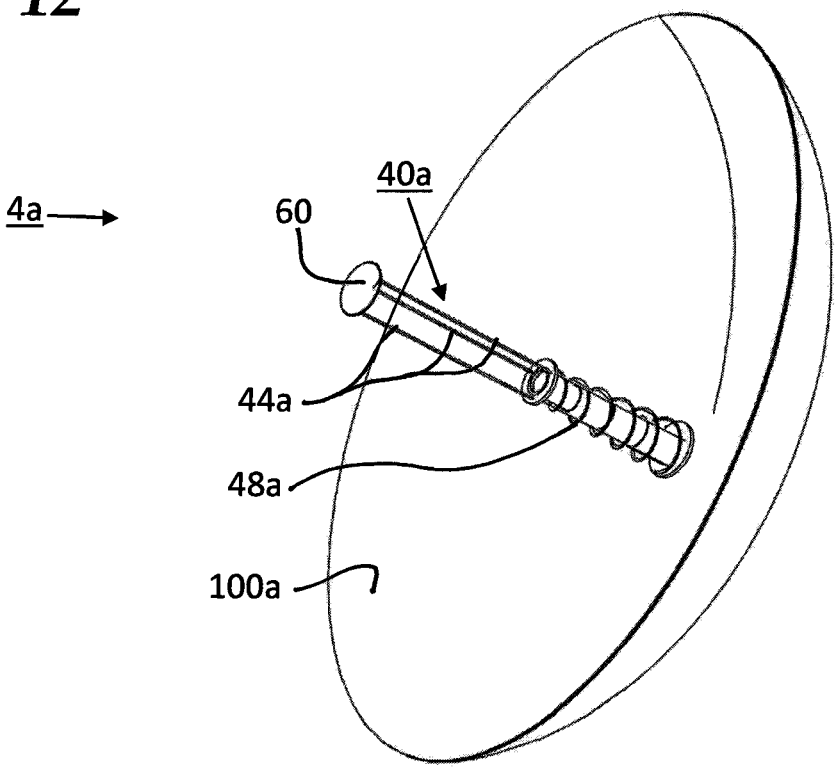
FIG. 12 is a perspective view of the antenna embodiment 4 in fully deployed configuration 4*a*.

An alternative antenna system embodiment 4 is illustrated on FIGS. 11 and 12. It comprises dish 100 with an alternative feed assembly 40 nested inside it. Upon application of heat to its components antenna system 4 transitions to its deployed configuration 4*a*.

Figure 13:
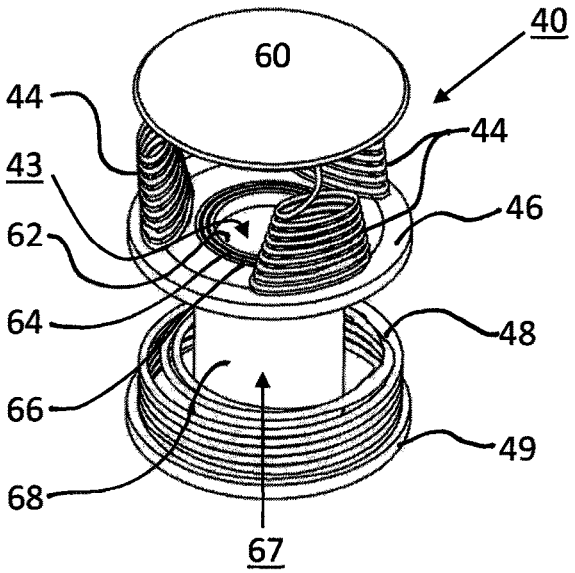
FIG. 13 is a perspective view of the feed assembly 40 in stowed configuration.

FIG. 13 depicts an alternative feed assembly 40 in stowed configuration. Feed 40 comprises secondary reflector 60 supported by extendable coiled supports 44 which rest on ring 46. Waveguide assembly 67 comprises nested tubular telescoping elements 62, 64, 66 and 68. Coiled feed actuator 48 is positioned around waveguide assembly and rests on ring 49. Numeral 43 denotes the lumen of waveguide assembly 67.

Figure 14:
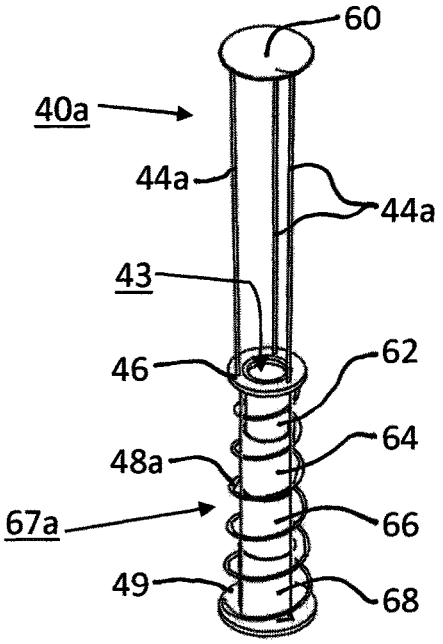
FIG. 14 is a perspective view of the feed assembly 40 in deployed configuration 40*a*.

FIG. 14 depicts feed assembly 40 in its deployed configuration 40*a*. Secondary reflector supports 44 extend from their coiled stowed configuration to their deployed straightened configuration 44*a* upon being heated by heater 51 (not shown). Telescopic waveguide assembly 67 is extended into its deployed configuration 67*a* by feed actuator 48 which assumes deployed configuration 48*a* after being heated by heater 52 (not shown).

Figure 15:
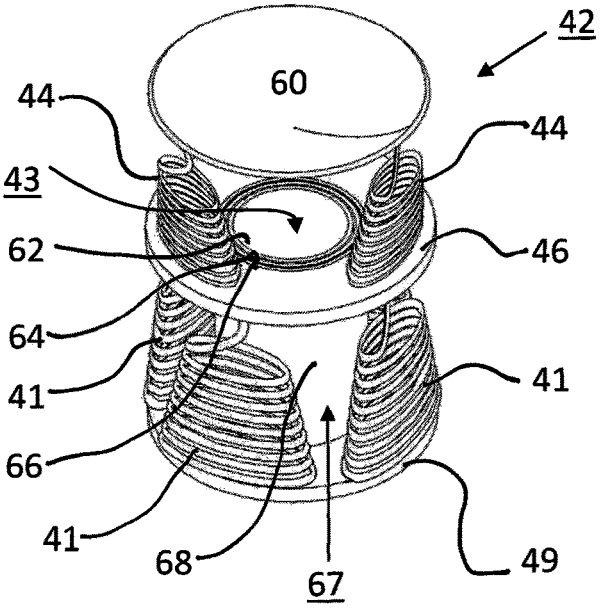
FIG. 15 is a perspective view of the feed assembly 42 in stowed configuration.

FIG. 15 depicts yet another variant of the feed assembly denoted 42, comprising secondary reflector 60 supported by extendable coiled supports 44 which rest on ring 46. Telescopic waveguide assembly 67 comprising telescoping elements 62, 64, 66 and 68 rests on support ring 49.

Figure 16:
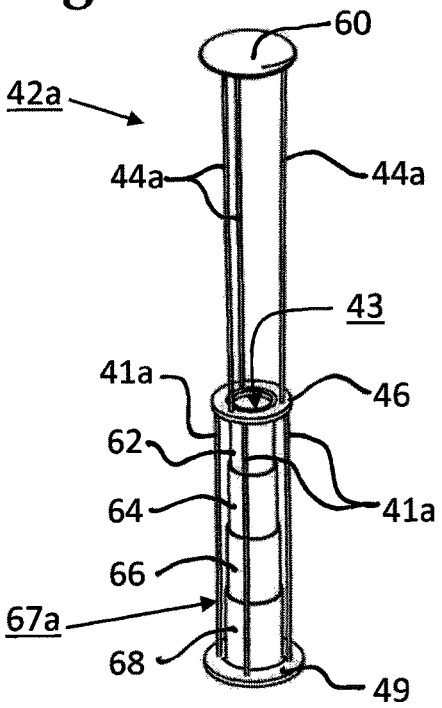
FIG. 16 is a perspective view of the feed assembly 42 in deployed configuration 42*a*.

FIG. 16 illustrates secondary reflector supports 44 extended from their coiled stowed configuration to their deployed straightened configuration 44*a* upon being heated by heater 51 (not shown). Coiled feed actuators 41 in their stowed configuration after heated by heater 52 (not shown) extend into their deployed straightened configuration 41*a* and urge waveguide 67 to its deployed configuration 67*a*.

Feed assemblies 40 and 42 can be deployed independently of dish 100 by actions of heaters 51 and 52.

Figure 17:
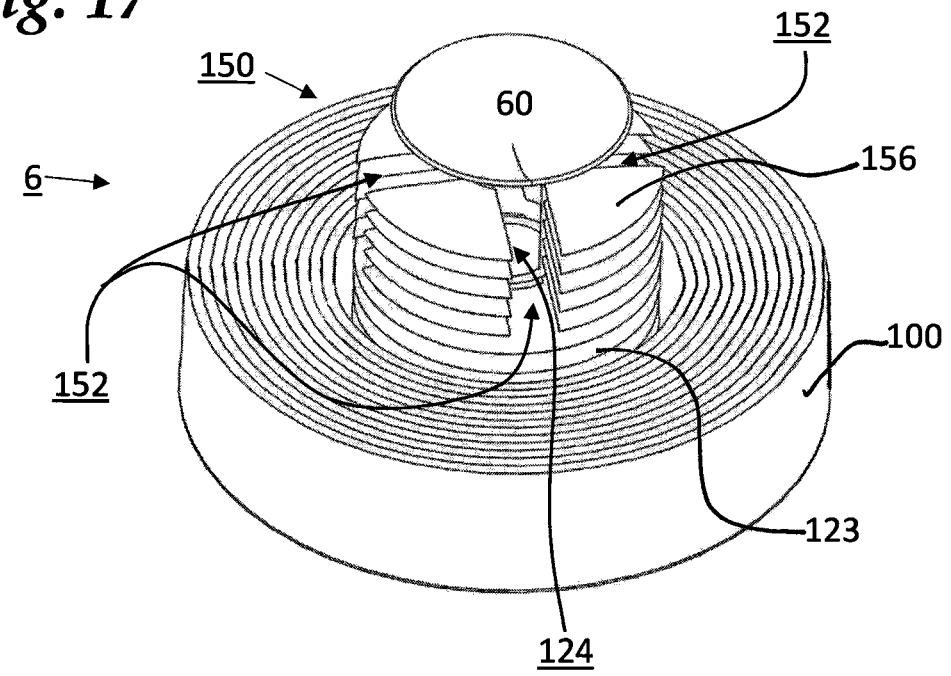
FIG. 17 is perspective view of the antenna embodiment 6 in stowed configuration.
Figure 18:
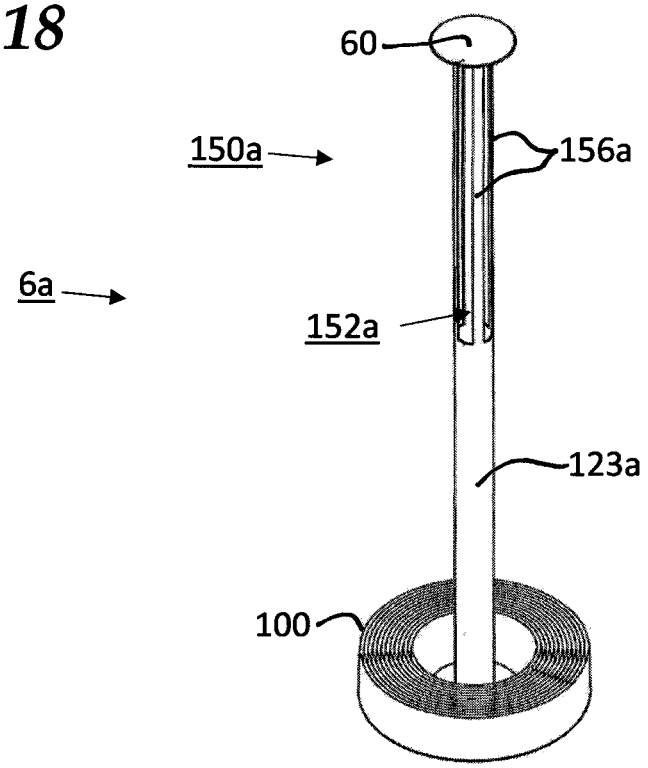
FIG. 18 is perspective view of the antenna embodiment 6 in partially deployed configuration 6*a*.
Figure 19:
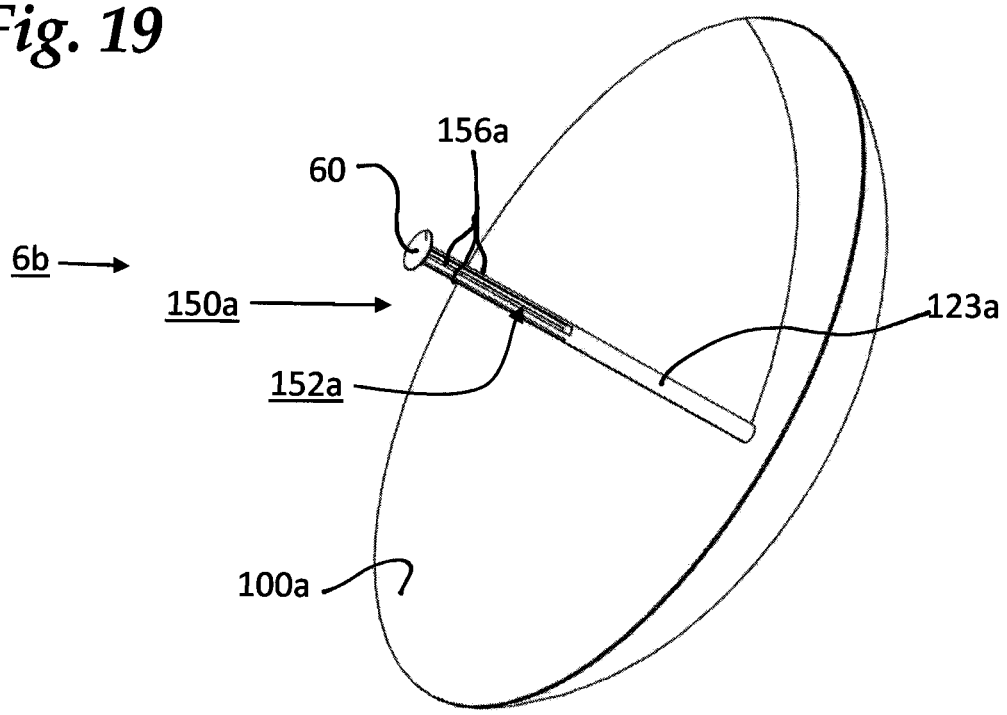
FIG. 19 is a perspective view of the antenna embodiment 6 in fully deployed configuration 6*b*.

An alternative antenna system embodiment 6 is illustrated on FIGS. 17 through 19. It comprises dish 100 and a feed assembly variant 150. Feed assembly 150 is similar in its construction to feed assembly 120, but secondary reflector 60 supports 156 are made integral with the feed body and are also made corrugated to extend longitudinally upon being heated. Supports 156 are separated by longitudinal slots 152 which permit electromagnetic energy emerging from feed lumen 124*a* to disperse upon reflection from reflector 60.

Upon application of heat supplied by heater 51 (not shown) supports 156 extend and assume their deployed shape 156*a* shown on FIG. 18. Also on FIG. 18, upon activation of heater 52 (not shown) feed body 123 extends and assumes its deployed configuration 123*a*, this configuration corresponding to the partially deployed antenna system configuration 6*a*. To complete deployment, dish 100 is transitioned into its deployed configuration 100*a* by cooperative action of bottom heaters 55*a*, 55*b* and 55*c* (not shown). The fully deployed antenna system 6*b* is shown on FIG. 19.

An alternative antenna system embodiment 8 is shown on FIGS. 21 through 24.

Antenna system 8 is close in construction to embodiment 4, with the difference being the supports for secondary reflector 60 and an extendable feed assembly variant 47. Feed assembly 47 is almost identical to feed assembly 40 with the difference being the absence of supports 44. Its activation by heater 52 (not shown) through the action of coil 48 transitioning to its deployed configuration 48*a*, and its subsequent deployed configuration 47*a* are also similar to those of feed assembly 40.

Figure 21:
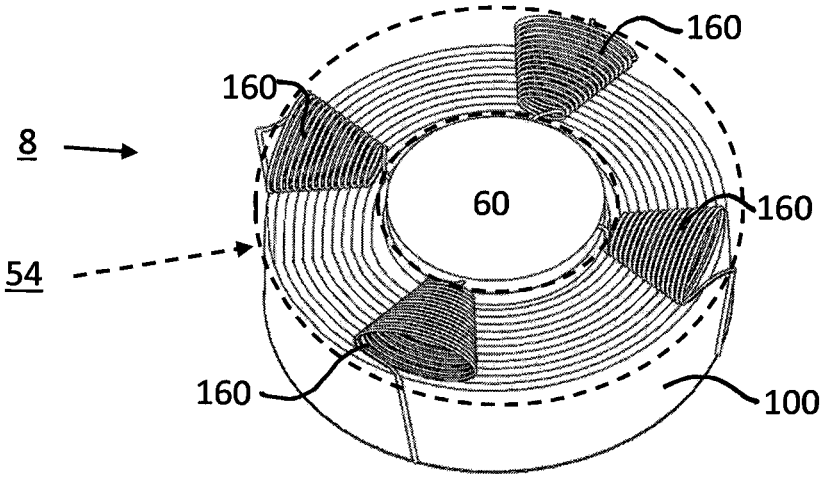
FIG. 21 is a perspective view of the antenna embodiment 8 in stowed configuration

Referring to FIG. 21, instead of supports extending from the waveguides of previous embodiments, reflector 60 is supported by coiled supports 160 connected to dish 100. Supports 160 extend from their stowed configuration to their extended configuration 160*a* upon application of heat by heater assembly 54 in the partial deployment of antenna system 8*a* depicted on FIG. 23. Heater assembly 54 is preferably of frusto-conical shape with aperture 57*a* on its apex to accommodate secondary reflector 60, and fits on top of stowed coiled supports 160 as shown in broken line.

Figure 22:
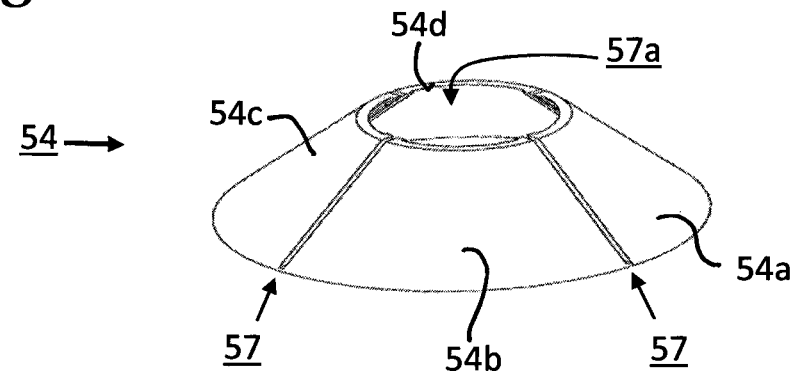
FIG. 22 is perspective view of the heating assembly 54.
Figure 23:
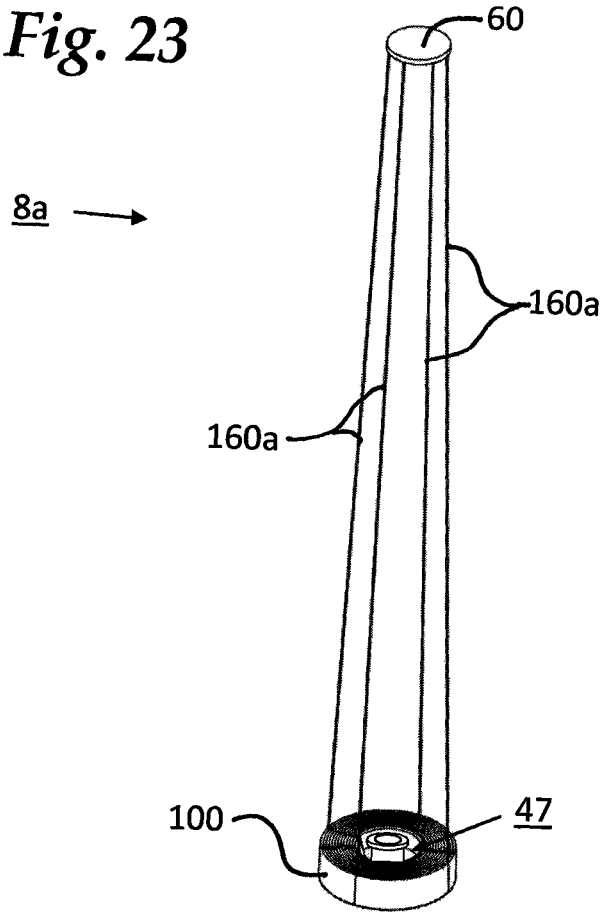
FIG. 23 is perspective view of the antenna embodiment 8 in a partially deployed configuration 8*a*.
Figure 24:
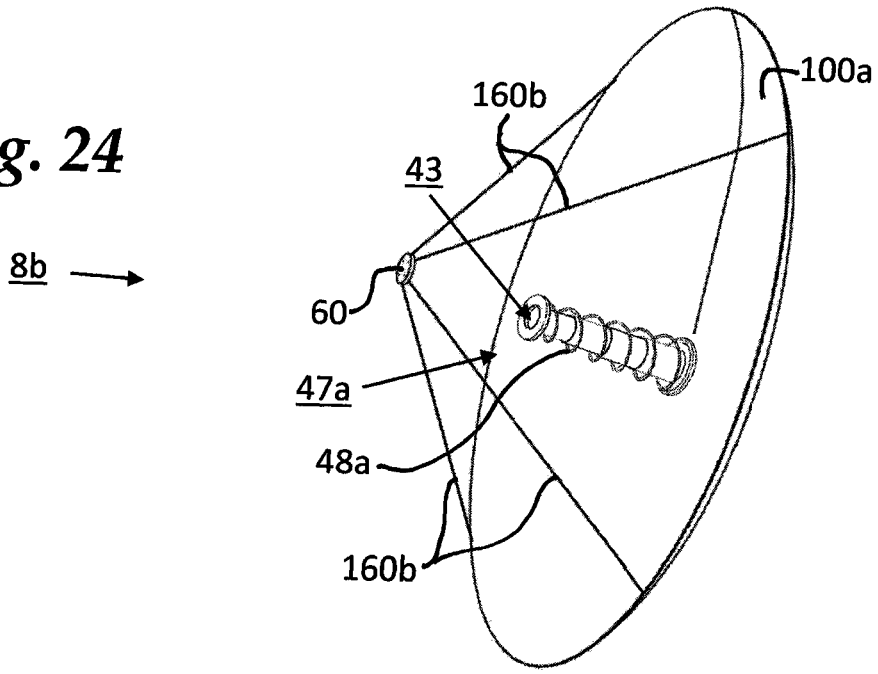
FIG. 24 is perspective view of the antenna embodiment 8 in a fully deployed configuration 8*b*.

As shown on FIG. 22, heater assembly 54 comprises heating elements 54*a*, 54*b*, 54*c* and 54*d* partially separated from each other by slots 57. When heated, supports 160 extend through slots 57 to deploy reflector 60. The connections between individual heating elements 54*a*, 54*b*, 54*c* and 54*d* are made to fracture when reflector supports 160 are deployed into their configuration 160*a* shown on FIG. 23.

The transition of antenna system 8 to its fully deployed configuration 8*b* is complete when dish 100 is in its deployed configuration 100*a* by cooperative action of bottom heaters 55*a*, 55*b* and 55*c* (not shown), feed assembly 47 in its deployed configuration 47*a* and supports 160 in their fully deployed configurations 160*b*.

In system deployed configuration 8*b* secondary reflector 60 is positioned to face deployed dish 100*a* and lumen 43 of feed 47.

Figure 25:
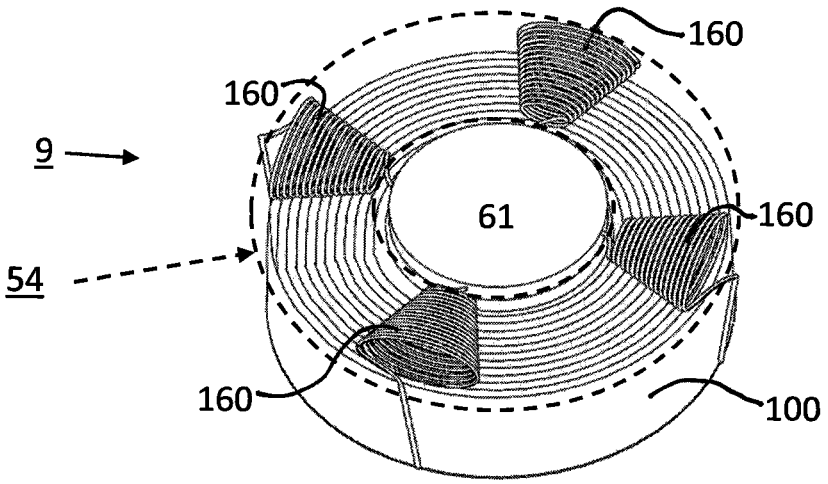
FIG. 25 is perspective view of the antenna embodiment 9 in a stowed configuration 9*a*.
Figure 26:
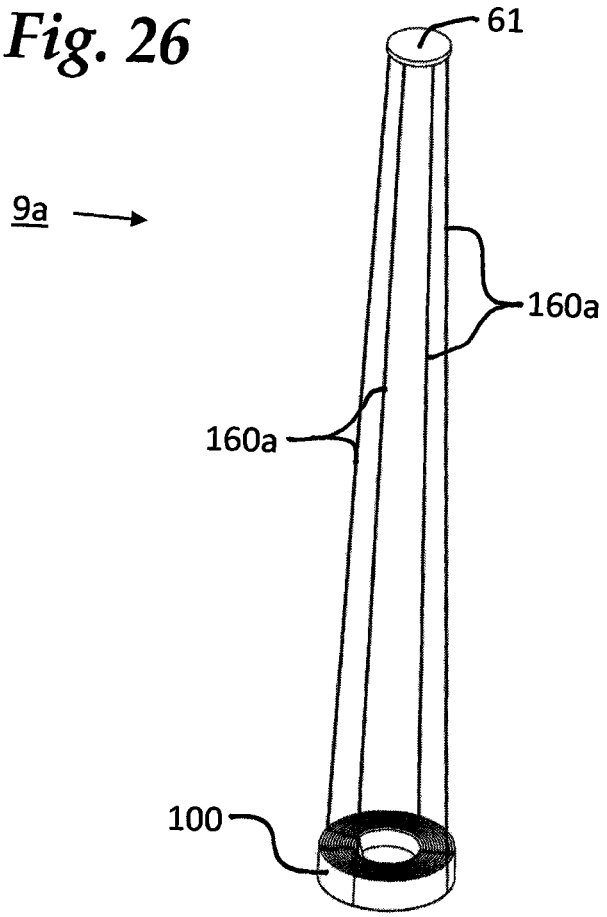
FIG. 26 is perspective view of the antenna embodiment 9 in a partially deployed configuration 9*a*.
Figure 27:
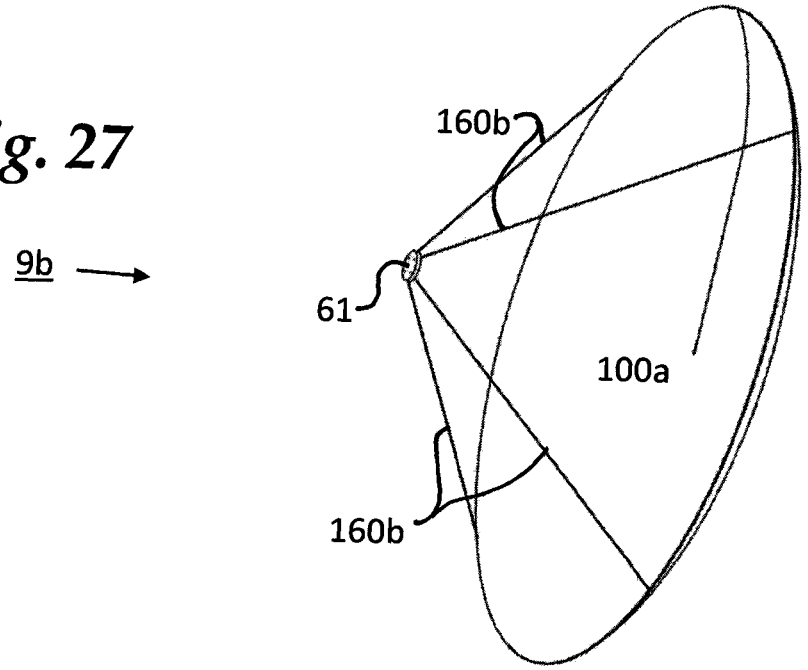
FIG. 27 is perspective view of the antenna embodiment 9 in a fully deployed configuration 9*b*.

FIGS. 25 through 27 show antenna embodiment 9 based on deployable rigid dish 100 with patch antenna 61 positioned by deployed supports 160*b* at the focus of the deployed dish 100*a*.

On FIG. 25 heater assembly 54 (shown schematically in broken lines) heats up supports 160 which extend to their intermediate deployed configuration 160*a* on FIG. 26 and deploy patch antenna 61.

Dish 100 is then deployed by action of bottom heaters 55*a*, 55*b* and 55*c* (not shown) and assumes its deployed configuration 100*a*, causing supports 160 to assume their final deployed configuration 160*b* which positions patch antenna 61 at the focal point of deployed dish 100*a*, thus completing deployment of antenna system in its fully deployed configuration 9*b*. Not shown on these figures is a radio-frequency cable which would normally connect patch antenna 61 to a transceiver on a satellite. Such a cable would be routed from a transceiver to patch 61 along one of supports 160*b*.

Since patch antenna 61 can both emit and receive electromagnetic radiation by itself, a dedicated feed is not required in the system.

Figure 28:
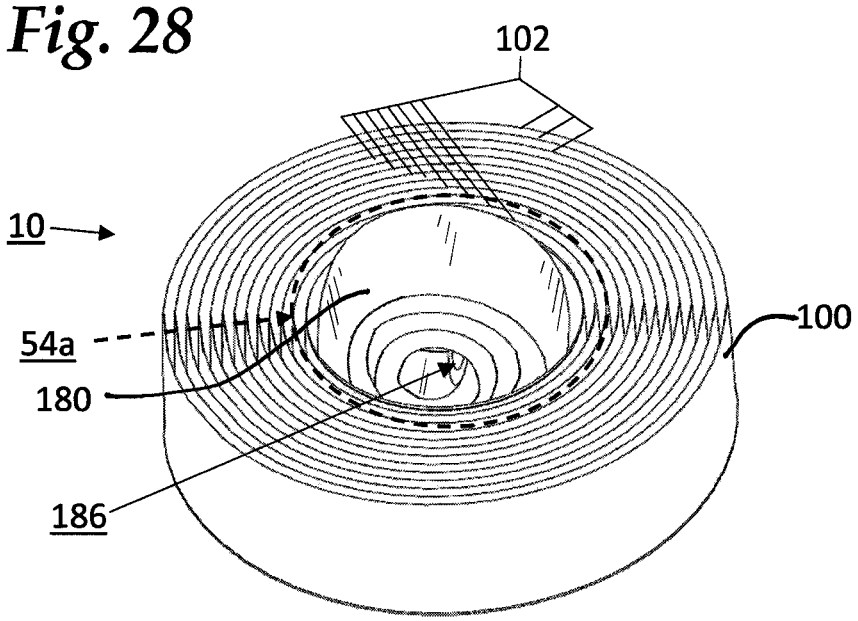
FIG. 28 is perspective view of the antenna embodiment 10 in a stowed configuration.
Figure 29:
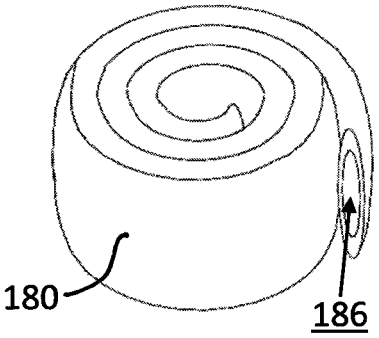
FIG. 29 is perspective view of the feed 180 in a stowed configuration.

Deployable antenna system 10 is depicted on FIG. 28 in its stowed configuration. Dish 100 and its bottom heaters 55*a*, 55*b* and 55*c* (not shown) are identical to the dish in previous antenna embodiments. Feed 180, made of a shape memory material comprises a hollow flattened cylinder spirally wound on itself comprising waveguide lumen 186 as shown on FIG. 29. Feed 180 is then installed in central depression 110 (not shown) of dish 100 in its stowed configuration as shown on FIG. 28 with its winding axis perpendicular to the longitudinal axis of dish 100. When heated by heater 54*a* which is similar to heater 54 of previous embodiments and is partially and notionally shown in broken lines on FIG. 28, feed 180 unfurls and assumes its U-shaped deployed configuration 180*a* shown on FIG. 30. Its lumen 186 simultaneously expands to a circular form 186*a* shown on FIG. 31. Feed 180 can also be heated directly with electric current, or by having conformal electrically resistive coatings applied to its outer surface.

Figure 30:
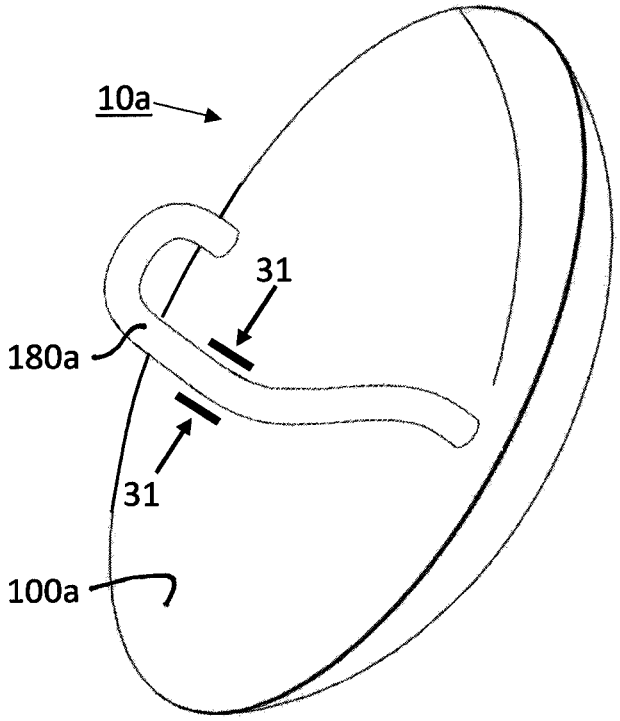
FIG. 30 is perspective view of the antenna embodiment 10 in its deployed configuration 10*a*.
Figure 31:
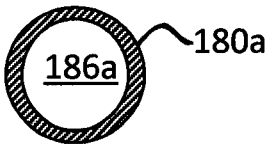
FIG. 31 is a cross section of feed 180 in its deployed configuration 180*a* taken along the line 31-31 on FIG. 30.

Referring to FIG. 30, antenna system 10*a* is in its fully deployed configuration with dish 100*a* deployed by coordinated action of heaters 55*a*, 55*b* and 55*c* (not shown) as in previous embodiments.

The shape memory materials used in the instant antenna system construction may include shape memory alloys ('SMAs') or shape memory polymers ('SMPs').

Shape memory alloys comprise numerous alloys such as AgCd, AuCd, cobalt-, copper-, iron-, nickel- and titanium-based, with most well-known and used being Cu—Al—Ni and Ni—Ti alloys (the latter known as 'nitinols').

Shape memory polymers comprise linear block polymers such as polyurethanes, polyurethanes with ionic or mesogenic components made by prepolymer method, block copolymer of polyethylene terephthalate (PET) and polyethyleneoxide (PEO), block copolymers containing polystyrene and poly(1,4-butadiene), and an ABA triblock copolymer made from poly(2-methyl-2-oxazoline) and polytetrahydrofuran.

Also, cross-linked PEO-PET block copolymers and PEEK can be used as shape memory elements of instant invention.

Some of these SMPs can be made to contain carbon which makes them electrically conductive. This conductivity can be advantageous for their direct heating with electrical current and the reflectance of the antenna dish made from them.

Operation

The controlled deployment sequences of antenna system elements ensure reliable deployment of the antenna, its achieving desired paraboloid configuration 100*a* and proper deployment and positioning of the feed, secondary reflector 60 or patch antenna 61.

Figure 32:
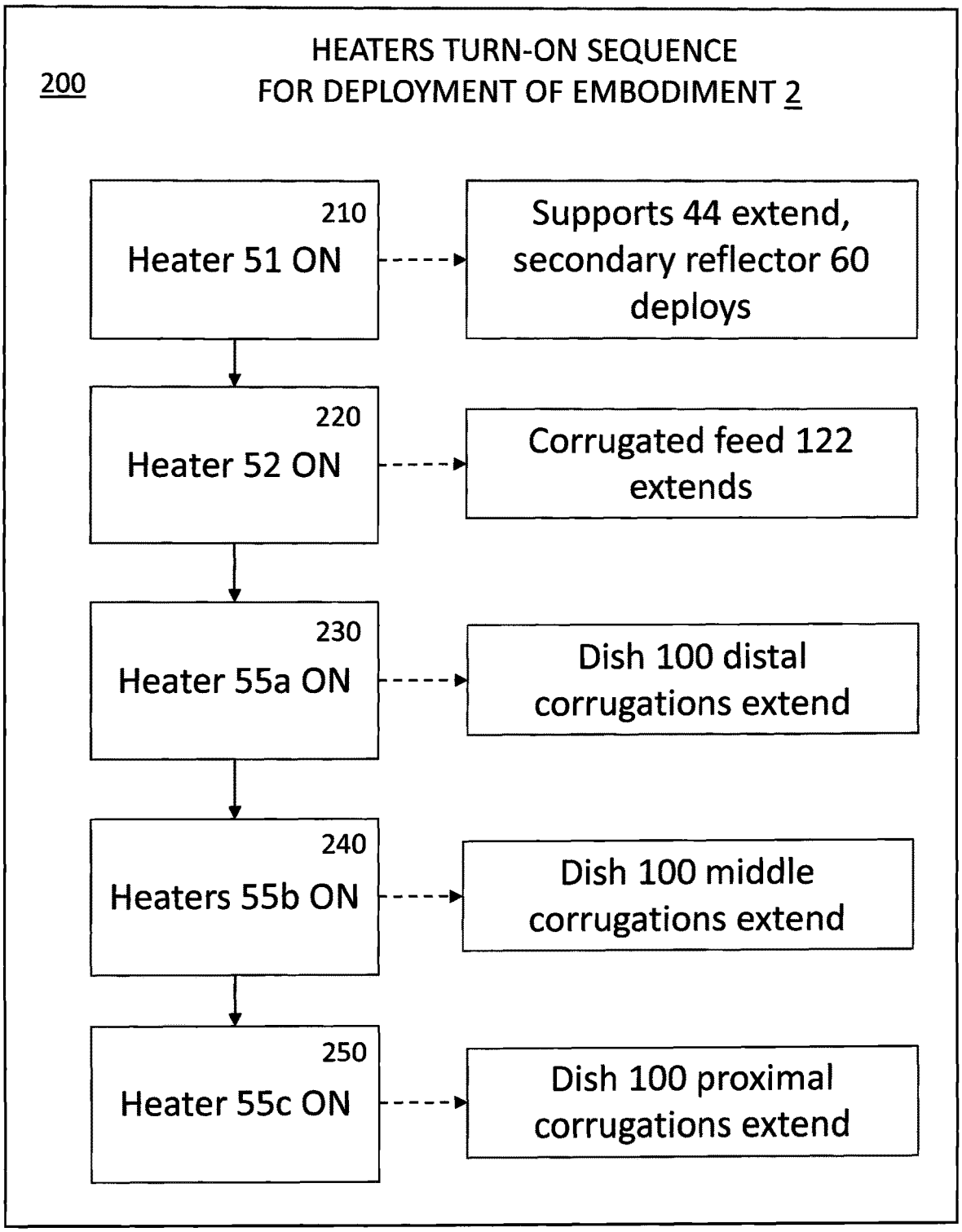
FIG. 32 is a diagram of the heaters activation sequence for deployment of antenna system embodiment 2.

Referring to FIG. 32, in sequence 200 which pertains to antenna system 2, secondary reflector supports 44 of feed 120 are extended first by activating heater 51 (step 210). Subsequently corrugated feed 123 is extended by activating heater 52 (step 220). Dish 100 is then controllably extended radially by a timed coordinated action of heaters 55*a*, 55*b* and 55*c*: first the distal pleats 102 are activated to extend by the action of heater 55*a* (step 230), then the middle pleats are activated by heater 55*b* (step 240), and finally the proximal pleats are activated by heater 55*c* (step 250). This sequence ensures controllable deployment of the rigid dish 100 from inside the stored configuration outwards, to form a paraboloid reflector 100*a*.

Figure 33:
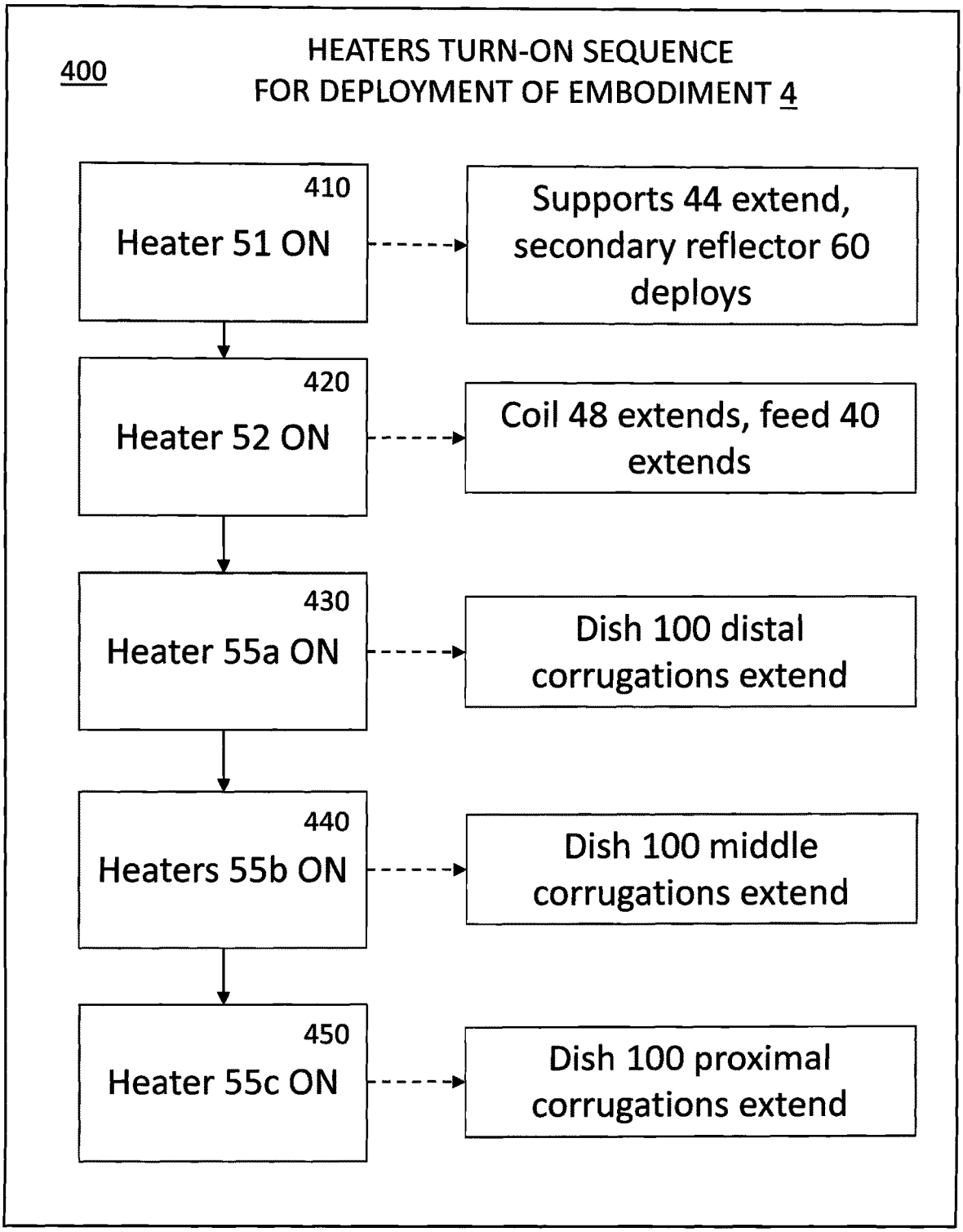
FIG. 33 is a diagram of the heaters activation sequence for deployment of antenna system embodiment 4.

Referring to FIG. 33, in sequence 400 pertaining to antenna system 4, reflector 60 supports 44 are extended first by activating heater 51 (step 410), followed by deployment of feed 40 by heating its deployment coil 48 by heater 52 (step 420). Dish 100 is deployed by a timed action of heaters 55*a*, 55*b* and 55*c* into its deployed configuration 100*a*.

Figure 34:
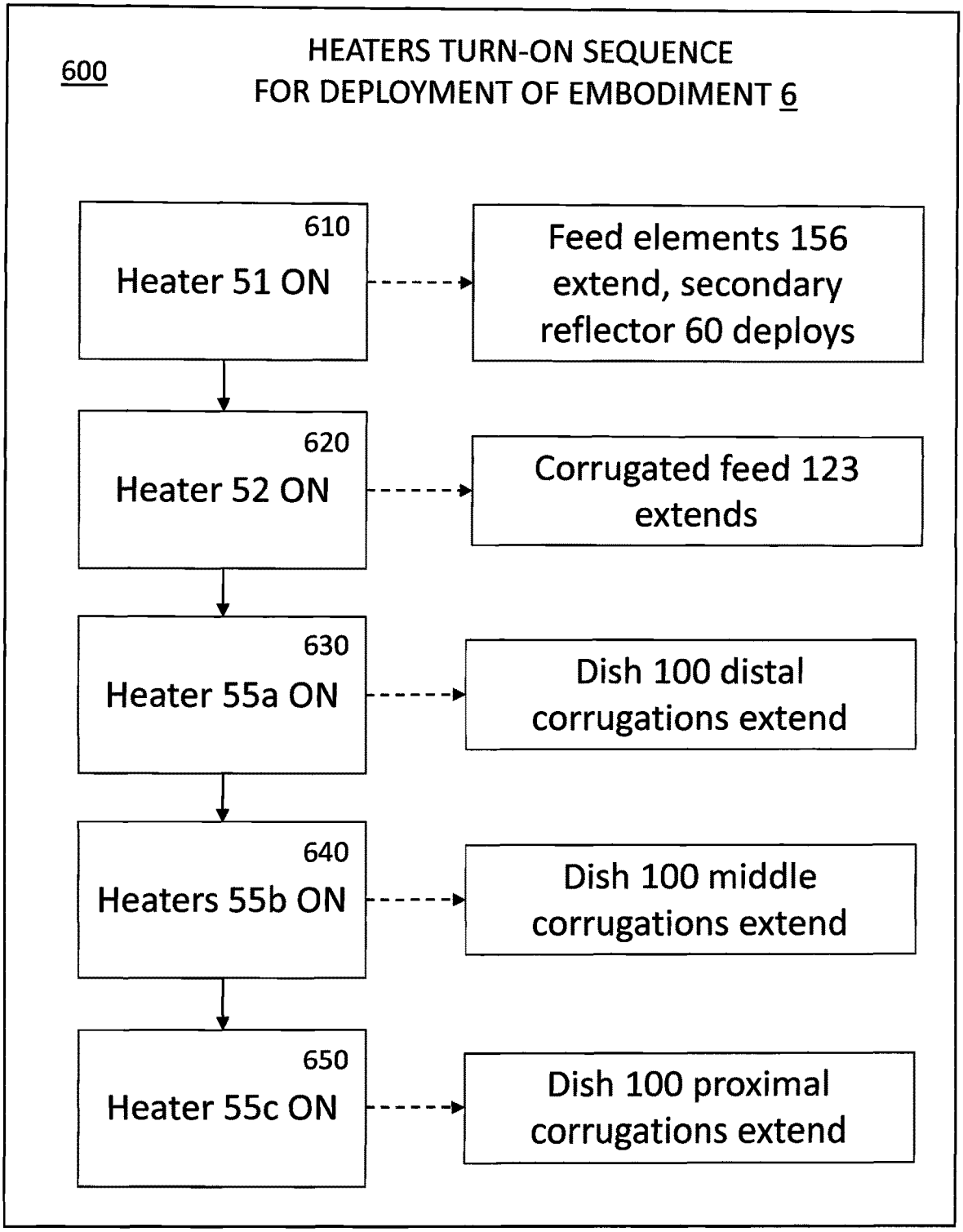
FIG. 34 is a diagram of the heaters activation sequence for deployment of antenna system embodiment 6.

Referring to FIG. 34, in sequence 600 which pertains to antenna system 6, secondary reflector supports 156 of corrugated feed 150 are extended first by activating heater 51 (step 610). Subsequently corrugated feed 123 is extended by activating heater 52 (step 620). Dish 100 is then controllably extended radially by a timed coordinated action of heaters 55*a*, 55*b* and 55*c*: first the distal pleats 102 are activated extend by the action of heater 55*a* (step 630), then the middle pleats are activated by heater 55*b* (step 640), and finally the proximal pleats are activated by heater 55*c* (step 650). This sequence ensures controllable deployment of the rigid dish 100 from inside the stored configuration outwards, to form a paraboloid surface 100*a*.

Figure 35:
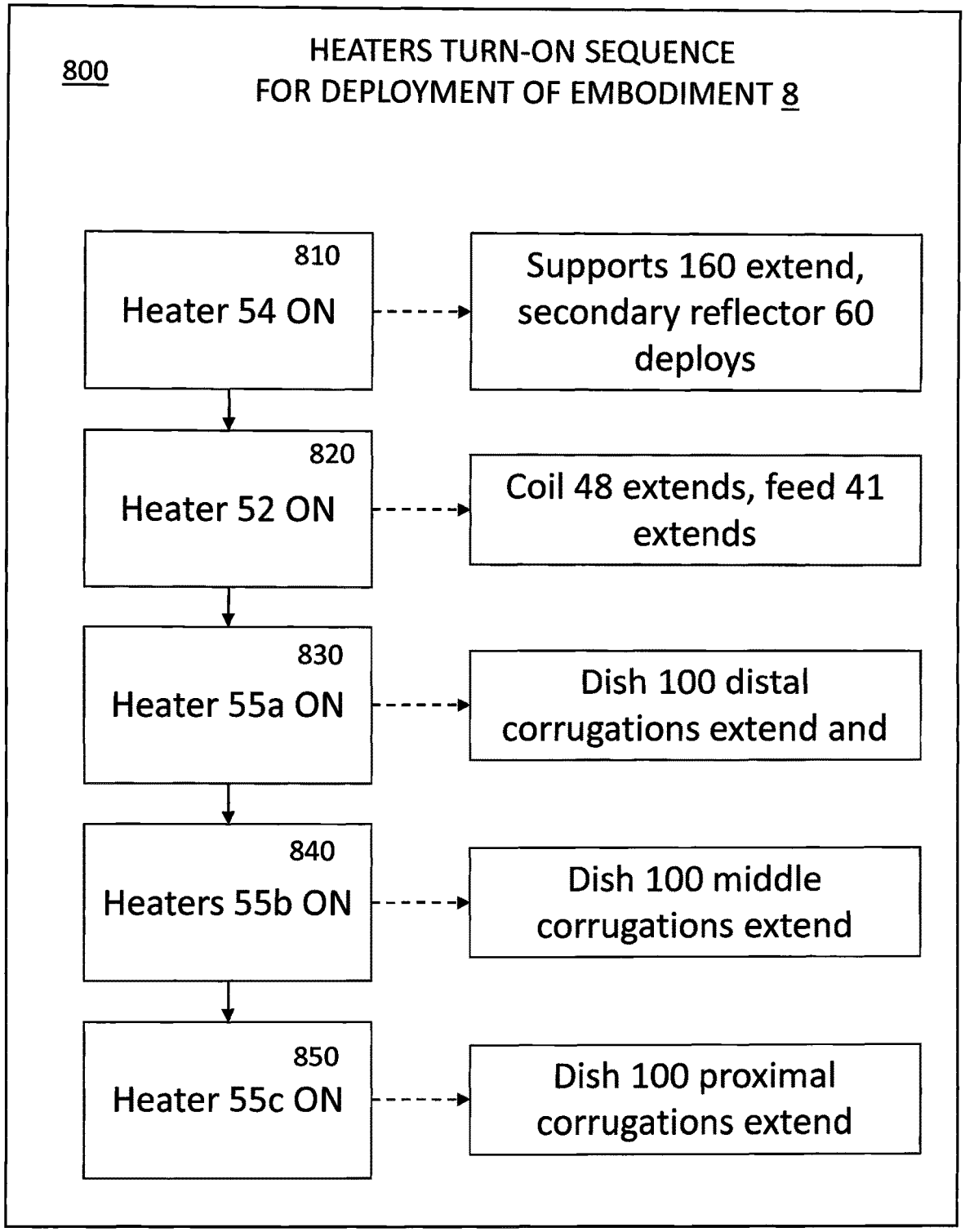
FIG. 35 is a diagram of the heaters activation sequence for deployment of antenna system embodiment 8.

Referring to FIG. 35, in sequence 800 which pertains to antenna system 8, supports 160 are extended to their intermediate deployment configuration 160*a* by activating heater assembly 54 (step 810). Feed 47 is then extended into its deployed configuration 47*a* by activating heater 52 which deploys feed coil 48 (step 820). Dish 100 is then controllably extended radially by a timed coordinated action of heaters 55*a*, 55*b* and 55*c*: first the distal pleats 102 are activated and extend by the action of heater 55*a* (step 830), then the middle pleats are activated by heater 55*b* (step 840), and finally the proximal pleats are activated by heater 55*c* (step 850). As dish 100*a* assumes its final deployed configuration, supports 160*a* assume their final deployed configuration 160*b* while positioning secondary reflector 60 at the focus of dish 100*a*.

Figure 36:
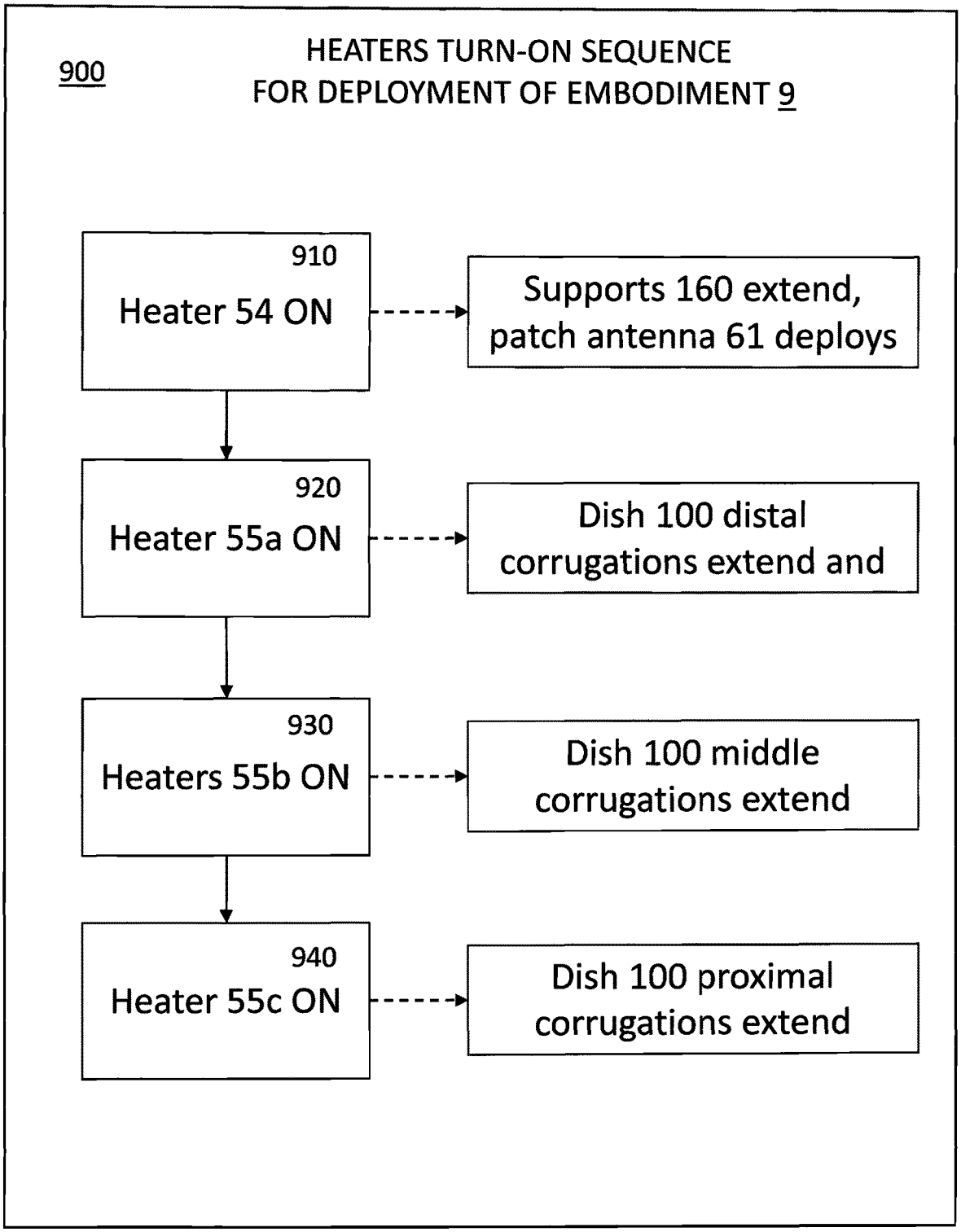
FIG. 36 is a diagram of the heaters activation sequence for deployment of antenna system embodiment 9.

Referring to FIG. 36, in sequence 900 which pertains to antenna system 9, supports 160 are extended to their intermediate deployment configuration 160*a* by activation of heater assembly 54 (step 910). Dish 100 is then controllably extended radially by a timed coordinated action of heaters 55*a*, 55*b* and 55*c*: first the distal pleats 102 are activated and extend by the action of heater 55*a* (step 920), then the middle pleats are activated by heater 55*b* (step 930), and finally the proximal pleats are activated by heater 55*c* (step 940). This sequence ensures controllable deployment of the rigid dish 100 from inside the stored configuration outwards, to form a paraboloid surface 100*a*. As dish 100*a* assumes its final deployed configuration, supports 160*a* assume their final deployed configuration 160*b* while positioning patch antenna 61 at the focus of dish 100*a*.

Figure 37:
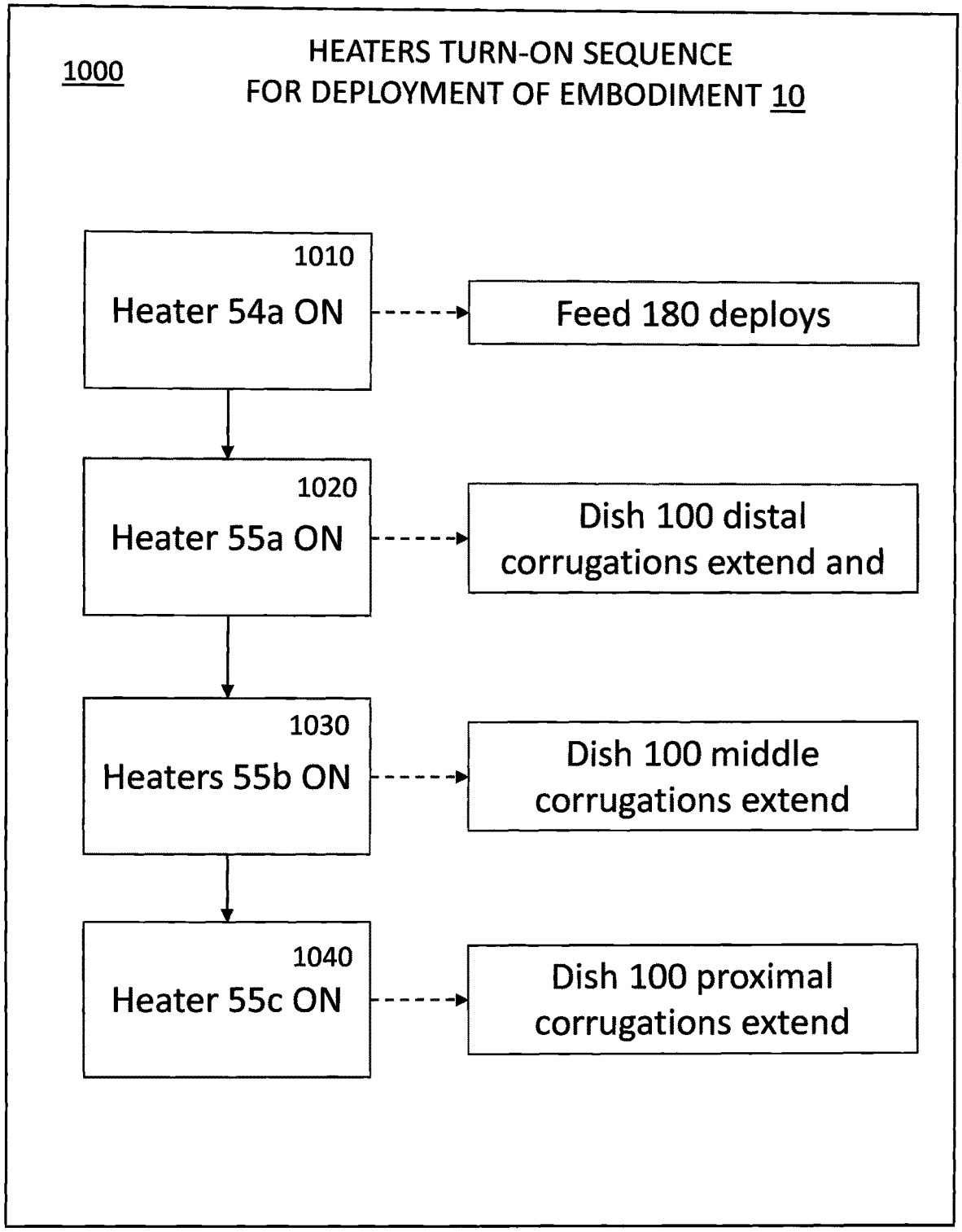
FIG. 37 is a diagram of the heaters activation sequence for deployment of antenna system embodiment 10.

Referring to FIG. 37, in sequence 1000 which pertains to antenna system 10, feed 180 extends to its intermediate deployment configuration 180*a* by activation of heater assembly 54*a* (step 1010). Dish 100 is then controllably extended radially by a timed coordinated action of heaters 55*a*, 55*b* and 55*c*: first the distal pleats 102 are activated and extend by the action of heater 55*a* (step 1020), then the middle pleats are activated by heater 55*b* (step 930), and finally the proximal pleats are activated by heater 55*c* (step 1040). This sequence ensures controllable deployment of the rigid dish 100 from inside the stored configuration outwards, to form a paraboloid surface 100*a*. Feed 180*a* has a U-shaped bend which points its waveguide lumen 186*a* towards dish 100*a*.

Other Embodiments

Figure 5:
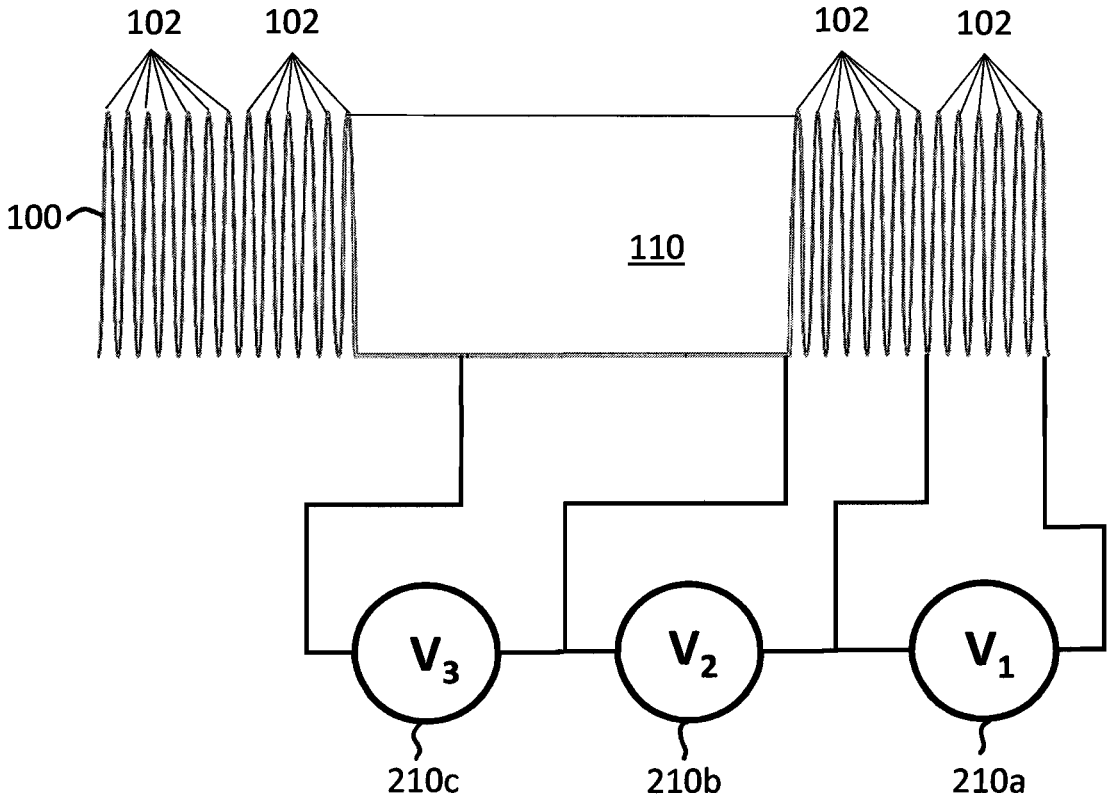
FIG. 5 is a schematic of a direct heating electrical system for dish 100.

On FIG. 5 dish 100 is shown to be directly heated by electric current passing through its sections and supplied by external voltage sources 210*a*, 210*b* and 210*c*. A coordinated timed operation of these sources ensures controlled deployment of dish 100 into its deployed configuration 100*a*. Shape memory materials utilized in dish 100 construction, such as metallic Ni-based alloys are advantageously suited for this, as they possess high electrical resistivity.

Voltage sources 210*a*, 210*b* and 210*c* can be combined into a single source attached in the center and outer edge of dish 100, if it is determined that a reliable deployment can be achieved with simultaneous heating of all parts of dish 100.

When dish 100 is directly heated electrically, in all antenna embodiments heaters 55*a*, 55*b* and 55*c* are not required.

Likewise, direct electrical heating can be used for feed and supports deployment, obviating the need for heaters 51, 52 and heater assembly 54.

Figure 20:
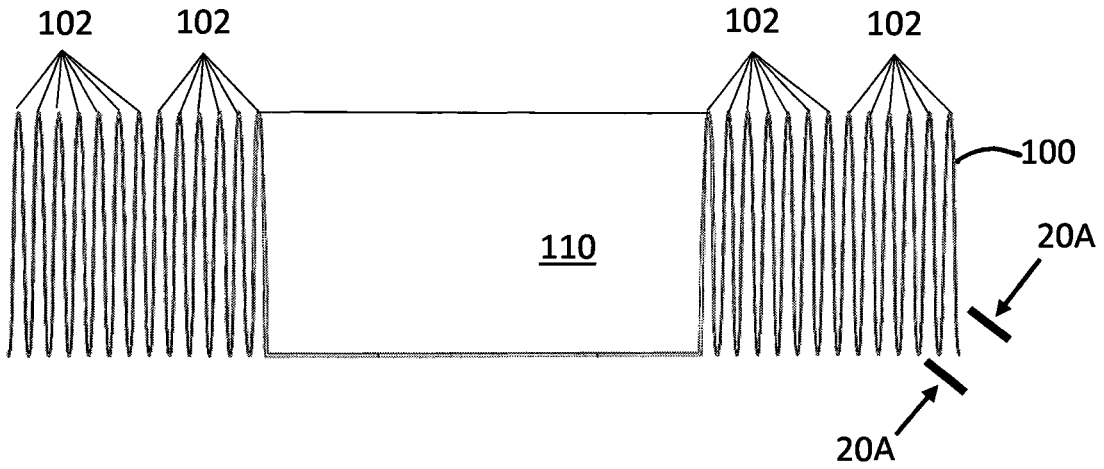
FIG. 20 is a cross section of a dish variant 101 in stowed configuration
Figure 20A:
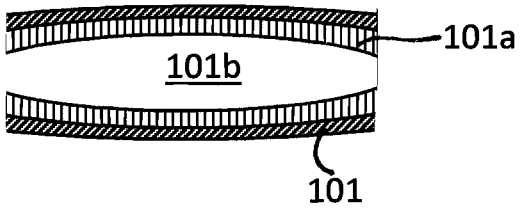
FIG. 20A is a cross section of dish variant 101 taken along line 20A-20A on FIG. 20 showing a heat pipe implementation.

FIG. 20 depicts a cross section of a dish variant 101 using heat pipe technology. As shown on FIG. 20A hollow shell 101 is lined inside with a wick 101*a* with lumen 101*b* to be occupied by a vapor phase of the heat transfer working compound. Shell 101 is then folded into the stored configuration, similar to dish 100's as an example depicted on FIG. 1. Heat to shell 101 is supplied by heater 55*c* at the center of the shell 101. Alternatively, it can be heated at the center by passing electric current supplied by voltage source 210*c* directly through it, as shown on FIG. 5.

A number of heat pipe technologies are well known in their respective art, and are widely used for heat transfer applications in satellites. Flat heat pipes in particular are also well known in the art.

Heat pipes advantageously transfer heat from one of their ends to another. As a result, a heat pipe is uniquely suitable for heating the distal end of the heat pipe-based shell 101 first, so it extends before the rest of the shell 101's sections do.

As the distal end of shell 101 heats up and assumes its deployed shape, heat is diffused along the shell and gradually raises the temperature of the middle- and then the proximal sections of shell 101. As a result, shell 101 radially extends to its full deployed size and shape.

In addition, heat pipe technology can be used for feeds 123, 150 and 180. Instead of solid shape memory shells from which these components are constructed, they can be made hollow and operate as heat pipes.

Additionally, feed actuators 41 and 48, supports 44 and 160 can all be made to utilize heat pipe technology as well.

By using heat pipe technology, heating of the shape memory elements can be greatly simplified, since heat can be applied from their proximal ends only and the resulting temperature distribution is fairly uniform from one end of a heat pipe to another.

Thanks to the nature of heat pipes operation, shape memory components' distal sections will be heated first, thus transforming them into their deployed configuration, to be followed by the proximal sections, as is desirable for reliable antenna deployment.

The heat pipes working compound can be water, ammonia or other, the first two being especially chemically compatible with nickel-titanium shape memory alloys which can be utilized for the antenna system.

Other antenna configurations, although not illustrated, are feasible.

Solid dish 100 can be perforated to reduce weight, provided the perforations are smaller than the operational electromagnetic wavelength of the antenna.

Also to save weight, a metallic wire mesh made from a memory shape material can be substituted for a solid sheet for dish 100.

Although shown as circular in its configurations, dish 100 can have an ovoid shape, deploying into an oblong paraboloid. Also, the feeds, secondary reflectors and patch antennae can be positioned at an angle to dish 100 centerline or off-center for off-axis dish operation. Such configurations are well known in the art.

Patch antenna 61 can have a receiver pre-amplifier and/or a transmit power amplifier integrated in it for a combined package held by supports 160*b*.

Figure 20C:
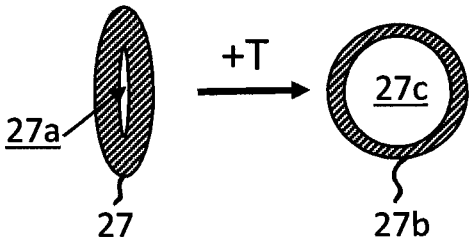
FIG. 20C is a cross section of an expandable cylindrical hollow supports possible with shape memory materials.
Figure 20B:
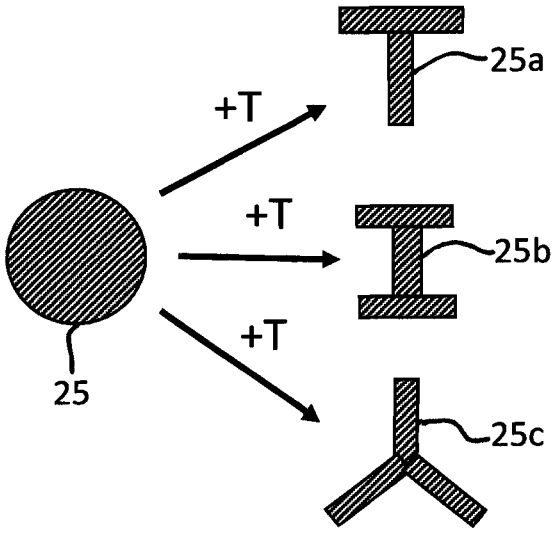
FIG. 20B are cross sections of solid supports possible with shape memory materials.
Figure 20D:
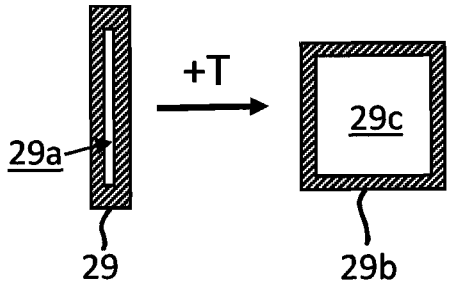
FIG. 20D is a cross section of an expandable rectangular hollow supports possible with shape memory materials.

As shown on FIGS. 20B, 20C and 20D, shape memory materials can be advantageously used to optimize the cross sections of antenna system members for both storage and deployment. The sign '+T' in the drawings designates application of heat to effect the shape transformation. A rod of the initial round cross section 25 of FIG. 20B can be transformed into a 'T'-(cross section 25*a*), 'Y'-(25*b*) or 'Y' (25*c*)-shaped beams respectively, each of which would have different mechanical characteristics. Likewise, hollow cross section ribbon-like elements 27 and 29 of FIGS. 20C and 20D respectively, while being conducive to packaging (such as bending and coiling) due to their flat initial shape and compressed lumens 27*a* and 29*a*, upon application of heat expand into their deployed configurations 27*b* and 29*b* with which have increased stiffness. Configuration similar to 27 is advantageously used for feed 180 in antenna system 10. Expanded lumens 27*c* and 29*c* in addition offer other advantageous applications capability, such as being used for heat pipes. For this application, a wick would be inserted inside these elements and/or their inside surfaces formed to enable condensate conduction. These technologies are known in heat pipe art.

Although shown as circular, feed lumens 43, 124*a* and 186*a* can be oval or rectangular, with different shape proportions. The resulting waveguides of these lumen geometries and their respective performance are well known in the art.

Various heat sources can be used to activate the shape memory elements and deploy the antenna, such as sunlight, chemical heat generators, electric infrared sources, and nuclear sources.

Shape memory components can have thermally absorbing coatings to facilitate their heating and deployment by sunlight.

Bottom heaters 55*a*, 55*b* and 55*c* do not have to be discrete, as single heating element can be sufficient in heating dish 100 for deployment if it is determined that the shape transformation is accomplished successfully. A heater with a radially varying heat output, for example made with a plurality of annular heating sub-elements or with varying radial density of individual heaters or a single element with radially varying resistance is also possible for controlled heating of dish 100.

Electrical contacts used for direct heating of shape memory components by electric current can be made to disengage from the heated components upon deployment.

The electrical contacts can also be made frangible, to also disengage from the components upon their deployment.

The power leads to the heaters on the shape memory components or the components themselves can be made retractable or coiled to retreat after the components' deployment.

Shape memory antenna components can have conductive or resistive film coatings deposited on their surfaces in various patterns to facilitate their controlled heating by electric current applied to these coatings and their resulting controlled deployment.

The feeds do not have to be centered with respect to the primary reflector, and the reflector itself does not have to be circularly symmetric. Rather, off-axis operation is possible, and, indeed, is widely practiced in the art.

Although descriptions provided above contain many specific details, they should not be construed as limiting the scope of the present invention.

Thus, the scope of this invention should be determined from the appended claims and their legal equivalents.

I claim:

1. A deployable antenna system comprising a rigid paraboloid reflecting dish, said dish made with shape memory material into a paraboloid shape, said dish having a stowed configuration and a deployed configuration, said dish in said stowed configuration comprising a radially pleated sheet, said deployed configuration comprising a paraboloid, wherein pleats of said sheet in said stowed configuration are co-linear with an axis of said paraboloid, said dish upon being heated to, near, or above the transition temperature of said material transforming from said stowed configuration to said deployed configuration, and a feed having a stowed configuration and a deployment configuration, said feed made of shape memory material, said feed upon being heated to, near, or above the transition temperature of said material transforming from said stowed configuration to said deployed configuration.

2. The antenna system of claim 1 wherein heating of said dish is configured to be effected by at least one external heater.

3. The antenna system of claim 1 wherein heating of said dish is configured to be effected by passing electric current through said dish.

4. The antenna system of claim 1 comprising a heat pipe heat exchanger, wherein said dish comprises a hollow sealed shell, said shell further comprising a lumen, said lumen configured for transporting a working thermal compound in liquid or vapor phase, said shell partially filled with said working thermal compound.

5. The antenna system of claim 1 wherein said feed, in said deployed configuration, comprising a tubular structure.

6. The antenna system of claim 5 wherein heating of said feed is configured to be effected by at least one externally located heater.

7. The antenna system of claim 5 wherein heating of said feed is configured to be effected by passing electric current directly therethrough.

8. The antenna system of claim 5 wherein said feed comprising, in said stowed configuration, a hollow axially pleated cylindrical shell, and in said deployed configuration, said tubular structure is a smooth elongated tubular structure.

9. The antenna system of claim 5 wherein said feed comprising in said stowed configuration a flattened tubular ribbon.

10. The antenna system of claim 5 wherein said feed comprising, in said stowed configuration, at least two nested co-axial tubular telescopic elements, having an outermost telescopic element and an innermost telescopic element, said innermost element nesting inside said outermost element, said feed further comprising an actuator, said actuator comprising at least two ends having a first end and a second end, said first end connected to said outermost element, said second end connected to said innermost element, said actuator made of shape memory material, said actuator upon being heated to, near, or above the transition temperature of said material extending longitudinally, said actuator configured to extend said elements from said stowed configuration to said deployed configuration of said feed.

11. The antenna system of claim 10 wherein said actuator comprising a helical coil, said coil disposed co-axially with said telescopic elements, said coil comprising inner diameter greater than said telescopic elements, said coil comprising two ends having a first end and a second end, said coil connected by said first end to said outer telescopic element and by said second end to said inner telescopic element, said coil, in a stowed configuration comprising a compressed configuration, said coil extending lengthwise upon by being heated to, near, or above the transition temperature of said memory shape material configured to extend said telescopic elements to said deployed configuration of said feed.

12. The antenna system of claim 10 wherein said actuator comprising at least one elongated rod, said rod made of shape memory material, said rod folded in stowed configuration, said rod comprising two ends having a first end and a second end, said first end connected to said outermost telescopic element, said second end connected to said innermost telescopic element, said rod extending from said stowed configuration to a deployed configuration upon being heated to, near, or above the transition temperature of said memory shape material, said rod configured to extend said telescopic feed to said deployed configuration of said feed.

13. The antenna system of claim 10 wherein heating of said actuator is configured to be effected by passing electric current through said actuator.

14. The antenna system of claim 10 wherein heating of said actuator is configured to be effected by at least one external heater.

15. The antenna system of claim 10 comprising a heat pipe.

16. The antenna system of claim 5 comprising a secondary reflector and at least one support for said reflector, said support comprising shape memory material, said support having a first stowed configuration and a deployed configuration, said support upon application of heat at, near, or above the transition temperature of said material configured to transform into said deployed configuration, said support connected at its proximal end to said feed, said support connected at its distal end to said secondary reflector, said deployed configuration of said support comprising an elongated shape.

17. The antenna system of claim 16 wherein said support in said stowed configuration comprises a coiled rod.

18. The antenna system of claim 16 wherein said support in said stowed configuration comprises an axially pleated tubular structure, said structure further comprising at least one longitudinal aperture.

19. The antenna system of claim 16 wherein heating of said support is configured to be effected by passing electric current through said support.

20. The antenna system of claim 16 wherein heating of said support is configured to be effected by at least one external heater.

21. The antenna system of claim 16 wherein said support comprising a heat pipe.

22. An antenna system comprising a rigid paraboloid reflecting dish, said dish made with shape memory material into a paraboloid shape, said dish having a stowed configuration and a deployed configuration, said dish in said stowed configuration comprising a radially pleated sheet, said deployed configuration comprising a paraboloid, wherein pleats of said sheet in said stowed configuration are co-linear with an axis of said paraboloid, said dish upon being heated to, near, or above the transition temperature of said material transforming from said stowed configuration to said deployed configuration, and a patch antenna and at least one support for said patch antenna, said support connected at its distal end to said patch antenna, said support connected at its proximal end to said dish, said support made of shape memory material, said support having a stowed configuration and a deployed configuration, said support configured to transform into said deployed configuration upon application of heat at, near, or above the transition temperature of said material, said support in said deployed configuration positioning said patch antenna at the focal point of said paraboloid dish.

23. The antenna system of claim 21 wherein heating of said support is configured to be effected by passing electric current through said support.

24. The antenna system of claim 21 wherein heating of said support is configured to be effected by at least one external heater.

25. The antenna system of claim 21 comprising a heat pipe.

26. A method of deploying a paraboloid antenna, comprising: providing a deployable paraboloid reflector, said reflector made from a shape memory material, said reflector in its stowed configuration comprising radially pleated shape, said reflector in its deployed configuration comprising a paraboloid, said reflector for deployment heated to a temperature at or above transition temperature of said shape memory material to cause said reflector to transition from said stowed configuration to said deployed configuration, and providing a feed having a stowed configuration and a deployment configuration, said feed made of shape memory material, said feed upon being heated to, near, or above the transition temperature of said material transforming from said stowed configuration to said deployed configuration.

27. The method of claim 26, wherein said feed further comprises a tubular telescopic feed, said feed comprising an elongated tubular shape in the deployed configuration, said feed further comprising a deployment mechanism, said mechanism made from memory shape material, applying heat to said deployment mechanism at, near, or above the transition temperature of said shape memory material to cause said mechanism to extend said feed into said deployed configuration.

28. The method of claim 26, wherein said feed in stowed configuration comprising a flattened tubular shape, in said deployed configuration comprising a lumen sufficient for propagating electro-magnetic radiation, and applying heat to said feed at, near, or above the transition temperature of said shape memory material to cause said feed to transition from said stowed configuration to said deployed configuration.

* * * * *